US007899367B2

(12) United States Patent
Fukuta

(10) Patent No.: US 7,899,367 B2
(45) Date of Patent: Mar. 1, 2011

(54) TONER CARTRIDGE, AGITATING MEMBER, AND IMAGE FORMING APPARATUS FOR USE THEREWITH

(75) Inventor: Hiroya Fukuta, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 813 days.

(21) Appl. No.: 11/676,867

(22) Filed: Feb. 20, 2007

(65) Prior Publication Data

US 2007/0196135 A1 Aug. 23, 2007

(30) Foreign Application Priority Data

Feb. 20, 2006 (JP) ..... 2006-042675

(51) Int. Cl.
*G03G 15/08* (2006.01)

(52) U.S. Cl. ..... 399/254; 399/263

(58) Field of Classification Search ..... 399/254, 399/255, 256, 263
See application file for complete search history.

(56) References Cited

U.S. PATENT DOCUMENTS

| | | | | |
|---|---|---|---|---|
| 6,456,810 | B1 * | 9/2002 | Deguchi et al. | 399/254 |
| 6,526,245 | B1 * | 2/2003 | Yamashita | 399/254 |
| 7,532,844 | B2 * | 5/2009 | Tanaka | 399/254 |
| 2005/0008400 | A1 * | 1/2005 | Tazawa et al. | 399/263 |

FOREIGN PATENT DOCUMENTS

| | | | |
|---|---|---|---|
| JP | 05-088548 | | 4/1993 |
| JP | 7199621 | A | 8/1995 |
| JP | 11024401 | A | 1/1999 |
| JP | 2000-155457 | A | 6/2000 |
| JP | 2000-338781 | A | 12/2000 |
| JP | 2001-318517 | A | 11/2001 |
| JP | 2002-156819 | A | 5/2002 |
| JP | 2002-236410 | A | 8/2002 |
| JP | 2003-156927 | A | 5/2003 |
| JP | 2005-070702 | | 3/2005 |
| JP | 2005-077572 | | 3/2005 |
| JP | 2005-134694 | | 5/2005 |
| JP | 2006-039365 | | 2/2006 |

OTHER PUBLICATIONS

Notice of Reasons for Rejection in corresponding Japanese Application 2006-042675, mailed Sep. 28, 2010.

* cited by examiner

*Primary Examiner* — David M Gray
*Assistant Examiner* — Joseph S Wong
(74) *Attorney, Agent, or Firm* — Banner & Witcoff, Ltd.

(57) ABSTRACT

An agitator includes a film formed with one or more slits. The film may be partitioned into two or more areas by the slits, substantially equally in an axial direction of a rotating shaft of the film. In both ends of a film holding member, supporting plates may be disposed at positions facing outer ends of both end areas of the film with respect to the axial direction. With this structure, during rotation of the agitator, greater stress may be produced in the outer end of each end area than in an inner end of each end area and a center area in its entirety. Thus, a component applied in a direction along the rotating shaft may be applied to a direction in which developer is fed, so that an adequate amount of developer may be supplied.

27 Claims, 22 Drawing Sheets

TONER CARTRIDGE, AGITATING MEMBER, AND IMAGE FORMING APPARATUS FOR USE THEREWITH

CROSS REFERENCE TO RELATED APPLICATION

This application claims priority from Japanese Patent Application No. 2006-042675, filed on Feb. 20, 2006, the entire subject matter of which is incorporated herein by reference.

FIELD

Aspects of the invention relate to an image forming apparatus such as a laser printer, and a toner cartridge, with an agitating member, which may be disposed in the image forming apparatus.

BACKGROUND

In a known image forming apparatus such as a laser printer, an electrostatic latent image is formed on a surface of a photosensitive drum, toner is supplied from a toner cartridge to the latent image, and the electrostatic latent image is developed into a toner image on the surface of the photosensitive drum. Then, the toner image is transferred to a sheet, so that image is formed on the sheet.

The toner cartridge includes a toner chamber, a developing chamber, and an agitating member. The toner chamber contains toner therein. The developing chamber communicates with the toner chamber via a toner supply opening. The agitating member is rotatably disposed in the developing chamber, and is configured to stir toner in the toner chamber. Toner in the toner chamber is stirred and moved toward the toner supply opening by rotation of the agitating member. The toner is supplied to the developing chamber via the toner supply opening. Toner supplied into the developing chamber is formed into and carried as a thin layer on a surface of a developing roller. The thin layer of toner on the surface of the developing roller is brought in contact with the surface of the photosensitive drum by rotation of the developing roller, and thus is supplied to the electrostatic latent image formed on the surface of the photosensitive drum.

Thus, the agitating member is required to efficiently convey toner in the toner chamber to the toner supply opening.

For example, there has been proposed an agitating member in which a plurality of flexible sheet pieces is arranged on a shaft. In the agitating member, flexibility of the sheet pieces disposed at both ends of the shaft is less than that of other sheet pieces, so as to improve the stirring force at both ends of the container where toner is stored.

Another agitating member is proposed that includes a flexible member that is rotatably and freely disposed within a toner supply container in order to carry toner to a toner supply port. The flexible member has a plurality of slits to define separate areas, each having a hole therein. Thus, toner can be collected toward the middle in the toner supply container, so that toner can be used efficiently.

However, in the first proposed structure, a direction of toner conveyance by a center sheet piece is the same as the direction of toner conveyance of each end piece, and it is difficult to provide a component along the rotation shaft to the direction of toner conveyance by the agitating member.

On the contrary, in the second proposed structure, the flexible member includes a hole and thus stiffness around the hole is weak. It may be possible to give the component along the rotation shaft to the direction of toner conveyance by the agitating member, however, with the provision of the hole, toner conveyance force by the flexible member may be reduced and an adequate quantity of toner cannot be conveyed to the toner supply port.

SUMMARY

One or more embodiments of the invention provide a toner cartridge, an agitating member, and an image forming apparatus, which are capable of adding a component including the axial direction to a direction where toner is conveyed.

BRIEF DESCRIPTION OF THE DRAWINGS

Illustrative aspects of the invention will be described in detail with reference to the following figures in which like elements are labeled with like numbers and in which.

DETAILED DESCRIPTION

Aspects of the invention relate to a toner cartridge, an agitating member, and an image forming apparatus for use with the toner cartridge.

It is noted that various connections are set forth between elements in the following description. It is noted that these connections in general and, unless specified otherwise, may be direct or indirect and that this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

Various embodiments will be described in detail with reference to the accompanying drawings.

Figure 1:
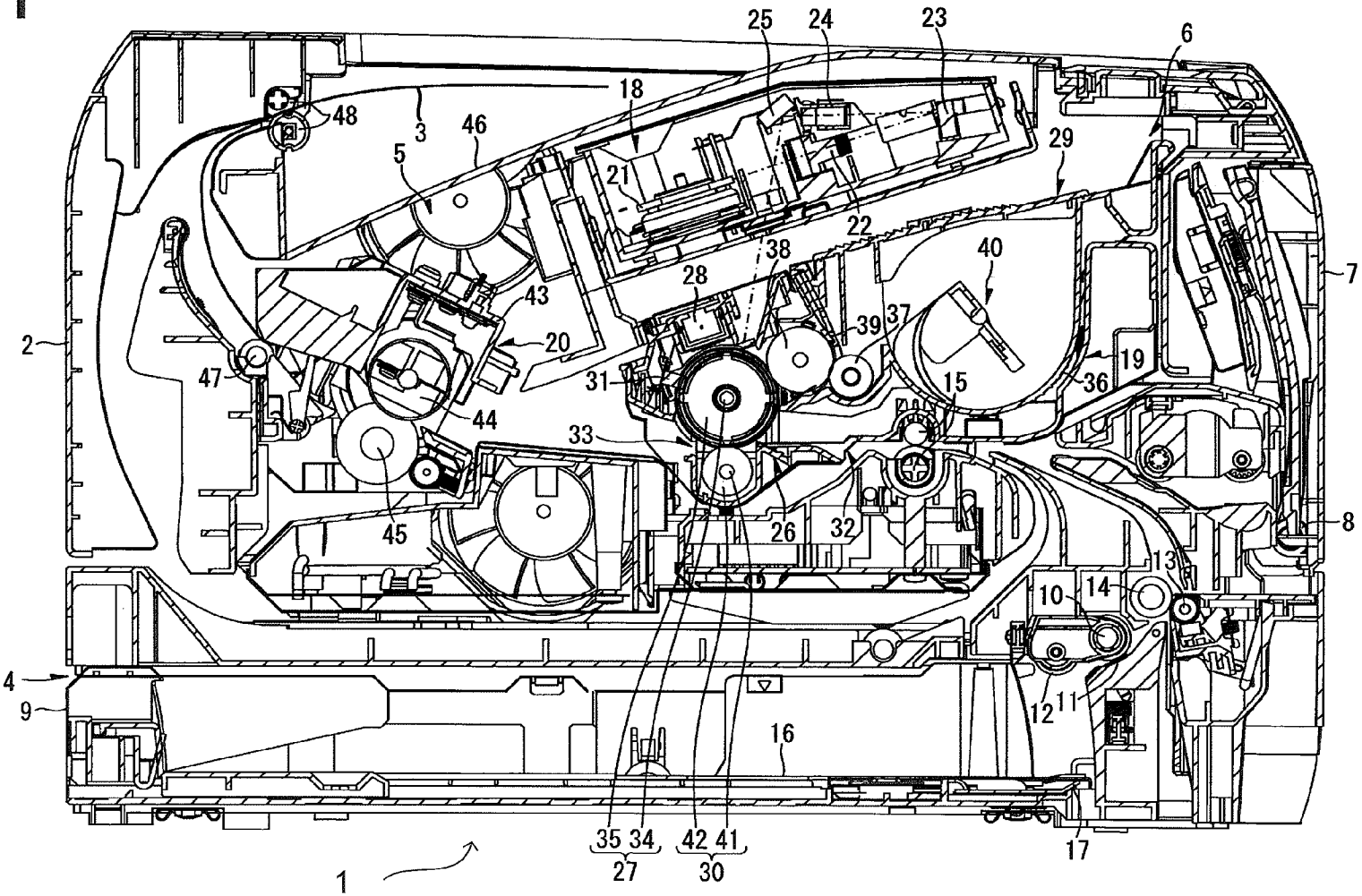
FIG. 1 is a side sectional view of a general structure of a laser printer as an image forming apparatus according to an embodiment of the invention.

As shown in FIG. 1, a laser printer 1 includes in a main body casing 2, a feeder unit 4 for feeding sheets 3, which serves as recording mediums, and an image forming unit 5 for forming a specified image on a sheet 3 fed by the feeder unit 4.

In the following description of the illustrated embodiments of the invention, a side of the laser printer 1 on which a front cover 7 is arranged will be referred to as the front or front side (the right side of FIG. 1), and a side opposite the side on which the front cover 7 is arranged will be referred to as the rear or rear side (the left side of FIG. 1). With regard to various individual objects of the laser printer 1 and/or a process cartridge 19, the six sides as front, rear, left, right, top and bottom of the individual objects will be similarly identified based on the arranged/attached position of the object on/in the main body casing 2 of the laser printer 1, unless otherwise specified. A direction from the front to the rear or from the rear to the front will be referred to as a front-rear direction. A direction from the top to the bottom or from the bottom to the top will be referred to as a top-bottom direction or a vertical direction. A direction from the left to the right or from the right to the left, that is orthogonal to the front-rear direction and the top-bottom direction, will be referred to as a left-right direction or a width direction.

The main body casing 2 has an attachment/detachment cavity 6 and a front cover 7 at the front side (right side in FIG. 1). The process cartridge 19 is attached to and removed from the main body casing 2 via the attachment/detachment cavity 6. The front cover 7 is supported by the main body casing 2 so as to pivot on a cover shaft 8 inserted into the front cover 7 at a lower end portion thereof. When the front cover 7 is closed on the cover shaft 8, the attachment/detachment cavity 6 is closed by the front cover 7. When the front cover 7 is opened (tilted) on the cover shaft 8, the attachment/detachment cavity 6 is opened by the front cover 7, so that the process cartridge 19 can be inserted in or removed from the main body casing 2 via the attachment/detachment cavity 6.

The feeder unit 4 is disposed at a bottom portion in the main body casing 2 and includes a sheet supply tray 9, a separation roller 10, a separation pad 11, a pickup roller 12, a paper dust removing roller 13, a pinch roller 14, and a pair of resister rollers 15. The sheet supply tray 9 is removably attachable along the front-rear direction. The separation roller 10 and the separation pad 11 are disposed at the upper front end of the sheet supply tray 9 to face each other. The pickup roller 12 is disposed behind the separation roller 10 or at an upstream side from the separation roller 10 with respect to a sheet feeding direction. The paper dust removing roller 13 is disposed in an upper front portion of the separation roller 10 or at a downstream side from the separation roller 10 with respect to the sheet feeding direction. The pinch roller 14 is disposed facing the paper dust removing roller 13. The resist rollers 15 are disposed in an upper rear portion of the separation roller 10.

The sheet supply tray 9 includes a sheet pressing plate 16 therein. The sheet pressing plate 16 is capable of loading a stack of sheets 3 thereon. The sheet pressing plate 16 is pivotally supported at its rear end. The sheet pressing plate 16 is vertically movable at its front end between a loading position and a conveying position. When in the loading position, the sheet pressing plate 15 is disposed such that its front end is positioned down and aligned with a bottom plate of the sheet supply tray 9. When in the conveying position, the sheet pressing plate 16 is disposed such that its front end is inclined upward from the bottom plate.

A lever 17 for raising the front end of the sheet pressing plate 16 is provided at a front end portion of the sheet supply tray 9. The lever 17 is supported under the front end portion of the sheet pressing plate 16 so as to move vertically.

When the front end portion of the sheet supply tray 9 is raised by the lever 17 and the sheet pressing plate 16 is disposed in the conveying position, an uppermost sheet 3 of the stack loaded on the sheet pressing plate 16 is pressed by the pickup roller 12 from underneath and is conveyed between the separation roller 10 and the separation pad 11 upon rotation of the pickup roller 12. The sheet 3 passes between the separation roller 10 and the separation pad 11 and then between the paper dust removing roller 13 and the pinch roller 14, where foreign matter such as dust is removed from the sheet 3 by the paper dust removing roller 13. The sheet 3 is inverted along a U-shaped sheet feed path and conveyed to the resist rollers 15.

The resist rollers 15 are disposed in a substantially horizontally extending portion of the U-shaped sheet feed path and configured to temporarily stop a sheet 3 fed in the sheet feed path and feed it to a transfer position between a photosensitive drum 27 and the transfer roller 30 during image formation in the image forming unit 5.

When the sheet supply tray 9 is removed from the main body casing 2, the sheet pressing plate 16 is located in the loading position, so that a stack of sheets 3 can be loaded on the sheet pressing plate 16.

The image forming unit 5 includes a scanner unit 18, a process cartridge 19, and a fixing unit 20.

The scanner unit 18 is disposed at an upper portion in the main body casing 2. The scanner unit 18 includes a laser light source (not shown), a polygon mirror 21, a first lens 22, a first reflecting mirror 23, a second lens 24, and a second reflecting mirror 25. In the scanner unit 18, as shown in a broken/dotted line, a laser beam emitted from the laser light source, based on print data, is deflected by the polygon mirror 21, passes through the first lens 22, is folded by the first reflecting mirror 23, passes through the second lens 24, is bent downward by the second reflecting mirror 25, and then directed to a surface of the photosensitive drum 27 of the process cartridge 19.

The process cartridge 19 is mounted below the scanner unit 18 in the main body casing 2. The process cartridge 19 is detachably attachable to the main body casing 2 via the attachment/detachment cavity 6.

The process cartridge 19 includes, in a drum frame 26, the photosensitive drum 27 serving as a photosensitive member, a scorotron charger 28, a developing cartridge 29 serving as a toner cartridge, a transfer roller 30, and a cleaning brush 31.

The drum frame 26 is provided with an inlet 32 and an outlet 33. A sheet 3 being fed in the sheet feed path enters the process cartridge 19 from the inlet 32 and exits the process cartridge 19 from the outlet 33.

The photosensitive drum 27 includes a metal drum shaft 34 and a cylindrical shaped drum body 35. The drum shaft 34 extends in the width direction, and is supported at both ends by the drum frame 26 so as not to rotate. The drum body 35 is formed such that its outermost layer is a positively charged photosensitive layer made of polycarbonate.

The scorotron charger 28 is supported by the drum frame 26 and disposed away from the photosensitive drum 27, so as to face the photosensitive drum 27 diagonally rearward from above. The scorotron charger 28 is configured to charge the surface of the photosensitive drum 27 uniformly and positively by corona discharge.

The developing cartridge 29 includes, in a case 36, a supply roller 37, a developing roller 38, serving as a toner carrying member, a layer-thickness regulating member 39, and an agitator 40 serving as an agitating member. The developing cartridge 29 may be designed to be detachably attachable to the drum frame 26. The developing cartridge 29 can be attached to and removed from the main body casing 2 along with the drum frame 26 when the developing cartridge 29 is kept in the drum frame 26. In addition, in one example, the developing cartridge 29 can only be attached to and removed from the main body casing 2 with the drum frame 26 remaining in the main body casing 2. With the developing cartridge 29 attached to the main casing 2, the developing roller 38 contacts the photosensitive drum 27 diagonally from front and from above. In other examples, a drum may be removed with developing cartridge 29.

The transfer roller 30 may be disposed below the photosensitive drum 27 in the drum frame 26, contacting the photosensitive drum 27 in a generally vertical direction. The transfer roller 30 includes a metal transfer roller shaft 41 and a transfer roller body 42 made of a conductive rubber material covering the transfer roller shaft 41. The transfer roller shaft 41 extends in the width direction, and is rotatably supported by the drum frame 26. During image transfer, a transfer bias is applied to the transfer roller 30.

The cleaning brush 31 is attached to the drum frame 26, and disposed facing the photosensitive drum 27 behind. The cleaning brush 31 is disposed in contact with the photosensitive drum 27 to scrape foreign matter such as dust adhering the surface of the photosensitive drum 27.

During image formation, the photosensitive drum 27 is rotatably driven, and the surface of the photosensitive drum 27 is uniformly charged by the scorotron charger 28. A laser beam from the scanner unit 18 is scanned at high speed at an area charged on the surface of the photosensitive drum 29, thereby forming an electrostatic latent image corresponding to an image to be formed on the sheet 3. Simultaneously, the developing roller 38 is rotatably driven and a thin layer of positively charged toner is formed on the surface of the developing roller 38. The thin layer of toner formed on the surface of the developing roller 38 is supplied to the photosensitive drum 29 with the electrostatic latent image, the electrostatic latent image is an exposure portion where the potential has become low due to exposure to the laser beam. The toner is then formed on the surface of the photosensitive drum 27 when the developing roller 38 contacts the photosensitive drum 27. As a result, the latent image on the photosensitive drum 27 becomes visible. Thus, toner image is formed on the surface of the photosensitive drum 27.

The toner image formed on the surface of the photosensitive drum 27 is transferred to a sheet 3 being fed by the resist rollers 15. In other words, while the sheet 3 having entered from the inlet 32 and passing through a transfer position between the photosensitive drum 27 and the transfer roller 30, the toner image is transferred from the surface of the photosensitive drum 27 to the sheet 3 via a bias applied to the transfer roller 30. The sheet 3 to which the toner image has been transferred is discharged from the outlet 33 and fed to the fixing unit 20.

The fixing unit 20 is disposed to the rear of the process cartridge 19. The fixing unit 20 includes a heat roller 44 and a pressure roller 45 in a fixing unit frame 43.

In the fixing unit 20, the toner image transferred onto the sheet 3 at the transfer position is fixed onto the sheet 3 by heat while the sheet 3 passes between the heat roller 44 and the pressure roller 45. The sheet 3, with the toner image having been fixed by heat, is fed to a discharge tray 46 formed on the top surface of the main body casing 2.

On a sheet discharge side from the fixing unit 20 to the discharge tray 46, the sheet feed path is inverted frontward in a substantially U shape. A feed roller 47 is disposed in the middle of the sheet feed path on the sheet discharge side. The sheet 3 fed from the fixing unit 20 is fed in the sheet feed path by the feed roller 47 and discharged onto the discharge tray 46 by ejection rollers 48.

The structure of the developing cartridge 29 will be described with reference to FIGS. 2 and 3.

The case 36 of the developing cartridge 29 includes a pair of sidewalls 51 facing each other in the width direction, a top wall 52 disposed between upper ends of the sidewalls 51, a bottom wall 53 disposed between lower ends of the sidewalls 51, and a front wall 54 disposed between front ends of the sidewalls 54. The case 36 can be in a box shape at the rear.

The bottom wall 53 integrally may include a front-side bottom wall 55, a middle bottom wall 56, and a rear-side bottom wall 57.

The front-side bottom wall 55 may be formed continuously from a lower end of the front wall 54, and is shaped in a substantially arc protruding downward in cross section.

The middle bottom wall 56 is formed continuously from a rear end of the front-side bottom wall 55, and may be shaped in a substantially arc protruding downward in cross section.

The rear-side bottom wall 57 is formed continuously from the middle bottom wall 56 and inclined downward to the rear side.

A boundary portion 58 between the front-side bottom wall 55 and the middle bottom wall 56 is substantially inverse V-shaped in cross section protruding upward. A partition wall 59 extends downward toward the boundary portion 58 and fully across the inside of the case 36 in a middle portion of the top wall 52 with respect to the front-rear direction. The inside of the case 36 is divided into a toner chamber 60 serving as a toner storing portion and a developing chamber 61 with the partition wall 59. The toner chamber 60 is disposed at the front of the partition wall 59, and the developing chamber 61 is disposed at the rear of the partition wall 59. The lower end of the partition wall 59 does not reach the boundary portion 58. Between the lower end of the partition wall 59 and the boundary portion 58, a toner supply opening 62 serving as a developer supply port is provided. The toner supply opening 62 extends fully across the inside of the case 36 and is substantially rectangular shaped. Toner stored in the toner chamber 60 is fed to the developing chamber 61 via the toner supply opening 62.

The toner chamber 60 is defined by the front part of each sidewall 51, the front part of the top wall 52, the front-side bottom wall 55 and the partition wall 59, while the developing chamber 61 is defined by the rear part of each sidewall 51, the rear part of the top wall 52, the middle bottom wall 56, the rear-side bottom wall 57, and the partition wall 59. The toner chamber 60 and the developing chamber 61 communicate with each other via the toner supply opening 62.

The toner chamber 60 contains positively charged non-magnetic single-component toner as a developing agent. The toner chamber 60 is provided with an agitator 40 for mixing toner. The agitator 40 includes an agitator rotating shaft 63 serving as the axis of rotation and a film 64 serving as a flexible member. The film 64 is circularly moved in the toner chamber 61 by rotation of the agitator rotating shaft 63. The agitator rotating shaft 63 extends in the width direction and is rotatably supported by the sidewalls 51. When the agitator rotating shaft 63 is driven, the film 64 is circularly moved in the toner chamber 60, and toner in the toner chamber 60 is mixed and fed to the developing chamber 61 via the toner supply opening 62.

In the developing chamber 61, the supply roller 37 is disposed along the middle bottom wall 56. The supply roller 37 is configured to supply toner, which is fed into the developing chamber 61, to the developing roller 38. The supply roller 37 includes a metal supply roller shaft 65 and a supply roller body 66 made of a conductive foaming material. The supply roller shaft 65 is covered with the supply roller body 66. The supply roller shaft 65 extends in the width direction, and is rotatably supported by the sidewalls 51.

The developing roller 38 is disposed behind the supply roller 37 in the developing chamber 61. The developing roller 38 is configured to supply toner to the photosensitive drum 27 (FIG. 1) and develop an electrostatic latent image formed on the photosensitive drum 27. The developing roller 38 includes a metal developing roller shaft 67 and a developing roller body 68 made of a conductive rubber material. The developing roller shaft 67 is covered with the developing roller body 68. The developing roller shaft 67 extends in the width direction and is rotatably supported by the sidewalls 51. Both ends of the developing roller shaft 67 protrude outwardly in the width direction from the corresponding sidewalls 51 and are covered with collar members 69.

The layer-thickness regulating member 39 is disposed in an upper portion of the developing roller 38. The layer-thickness regulating member 39 is configured to regulate toner carried on the developing roller 38 to a thin layer. The layer-thickness regulating member 39 is attached to a blade attaching portion 70 extending between upper ends at the rear ends of the sidewalls 51. More specifically, the layer-thickness regulating member 39 may include of a metal plate spring member, and its base end fixed between the blade attaching portion 70 and a fixing member 72 with a sealing member 71, for prevention of toner leakage, interposed therebetween. A free end of the layer-thickness regulating member 39 is provided with a pressing portion 73 having a generally semicircular shape in cross section and made of insulative silicone rubber. The pressing portion 73 is elastically pressed against the developing roller 38.

Toner fed into the developing roller 61 is supplied to the developing roller 38 through the rotation of the supply roller 37, while being positively and frictionally charged between the supply roller 37 and the developing roller 38. Toner supplied onto the developing roller 38 passes between the pressing portion 73 of the layer-thickness regulating member 39 and the developing roller 38 along with the rotation of the developing roller 38, while the toner is uniformly regulated to a specified thickness as a thin layer and carried on the developing roller 38.

The structure of the agitator 40 will be described with reference to FIGS. 4 to 7.

The agitator rotating shaft 63 can be made of hard resin such as ABS resin, and may include a round rod-like shaft body 80, a film holding member 81, and wiper holding members 82. The shaft body 80 extends in the width direction, which is a longitudinal direction, of the case 36 (FIG. 3). The film holding member 81 is fixed on one side of the shaft body 80 with respect to a radial direction thereof. The wiper holding members 82 are fixed on the opposite side of the shaft body 80 from the film holding member 81.

The film holding member 81 includes a film adhering plate 83, a plurality of connecting rods 84, and a closing plate 85. The film adhering plate 83 is a thin-plate like member extending in an axial direction of the shaft body 80, which is equal to the longitudinal direction of the case 36 (or a film 64, which will be described later), and hereinafter referred to as "the axial direction". The connecting rods 84 are spaced in the axial direction, and disposed between the film adhering plate 83 and the shaft body 80. The closing plate 85 is provided so as to close a space between the film adhering plate 83 and the shaft body 80 from one side.

The film adhering plate 83 is disposed away from the shaft body 80 so that one side of the film adhering plate 83 is parallel to the shaft body 80. The other side of the film adhering plate 83, which is far from the shaft body 80, is a surface to which a film 64 is adhered.

The film 64 may be made of polyethylene terephthalate (PET) and may have a rectangular shape elongated in the axial direction. A base end of the film 64, which is one end with respect to the direction orthogonal to the axial direction, is adhered to the film adhering plate 83. The film 64 extends in a direction opposite from the closing plate 85. Although the film 64 is shaped in a rectangle, it may be designed in any shape such as a polygon or curve and may or may not be chamfered at its free end opposite to the base end have the base end may be elongated in the axial direction.

The film 64 is formed with two slits 86. Each slit 86 extends from a free end of the film 64 (where the film 64 is not adhered to the film adhering plate 83) near to the film adhering plate 83. The free end of the film 64 is divided into three areas 64A, 64B, 64C which are substantially equal with respect to the axial direction.

The wiper holding portions 82 are provided at both ends of the shaft body 80. Each wiper holding portion 82 includes a wiper 87 having a substantially rectangular shape. The wiper 87 is made of an elastic material such as urethane rubber.

Each wiper 87 protrudes outward from the corresponding wiper holding member 82 with respect to the axial direction of the shaft body 80 or the longitudinal direction of the case 36, and an edge of each wiper 87 elastically contacts the inner surface of the sidewall 51 of the case 36. Thus, while the wiper 87 moves around the shaft body 80 upon the rotation of the agitator rotating shaft 63, it slides on the inner surface of the sidewall 51, and wipes a toner detection window 74 (FIG. 3) provided on the corresponding sidewall 51. The toner detection window 74 is configured to allow light to pass through, where the light is used detecting toner remaining in the toner chamber 61, is the light being directed from a light-emitting device disposed on one side outside of the case 36 to a photoreceptor disposed on the other side. The accuracy to detect remaining toner can be improved by wiping the toner detection window 74.

Figure 2:
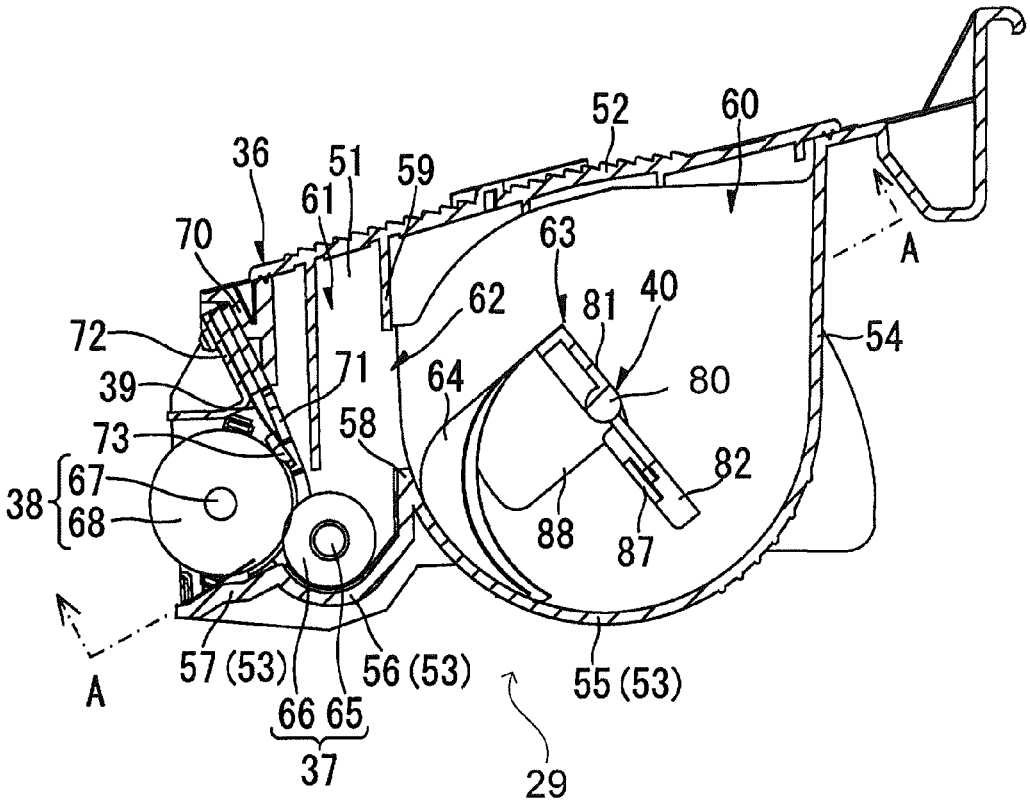
FIG. 2 is a sectional view of a developer cartridge shown in FIG. 1.
Figure 3:
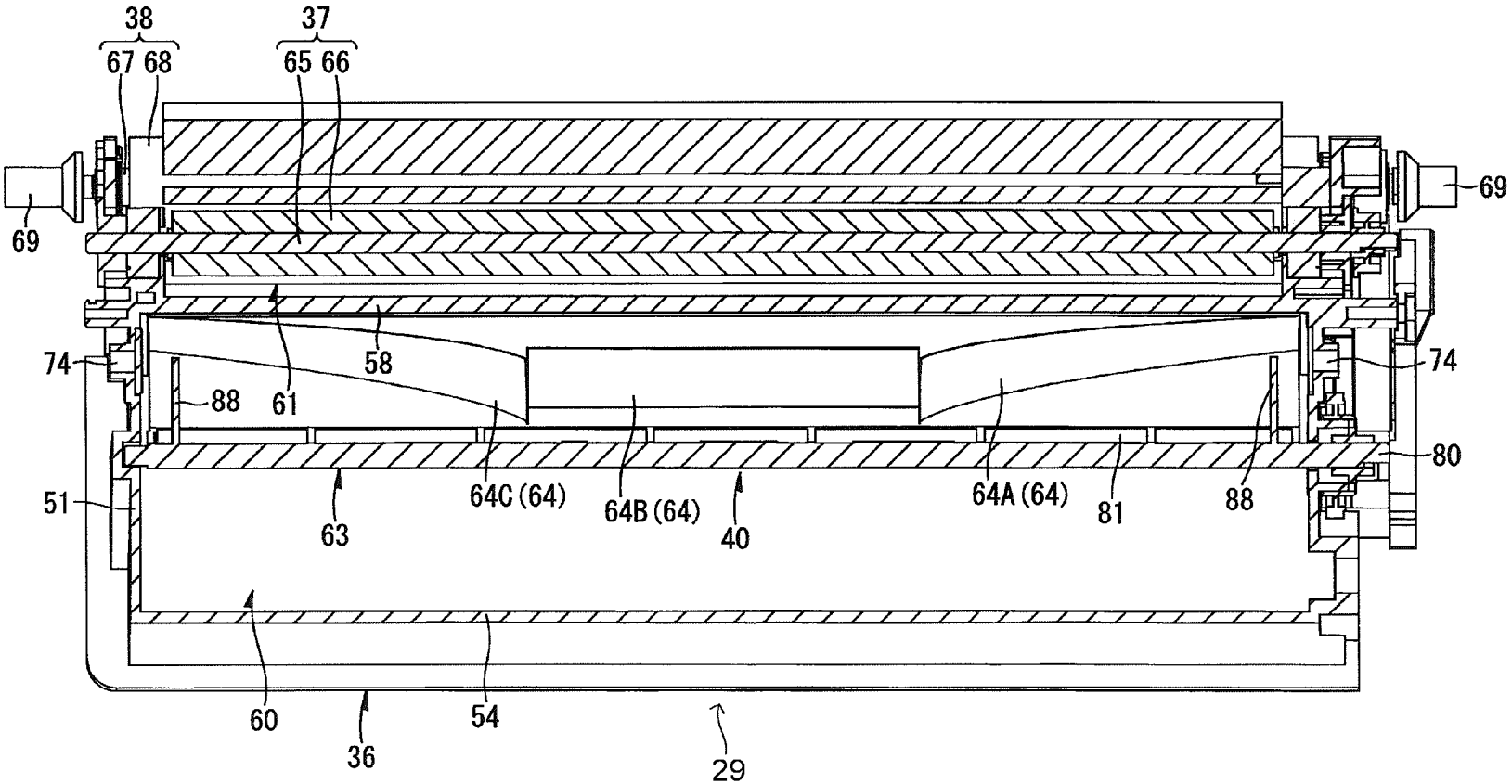
FIG. 3 is a sectional view of the developer cartridge taken along the line A-A of FIG. 2.
Figure 4:
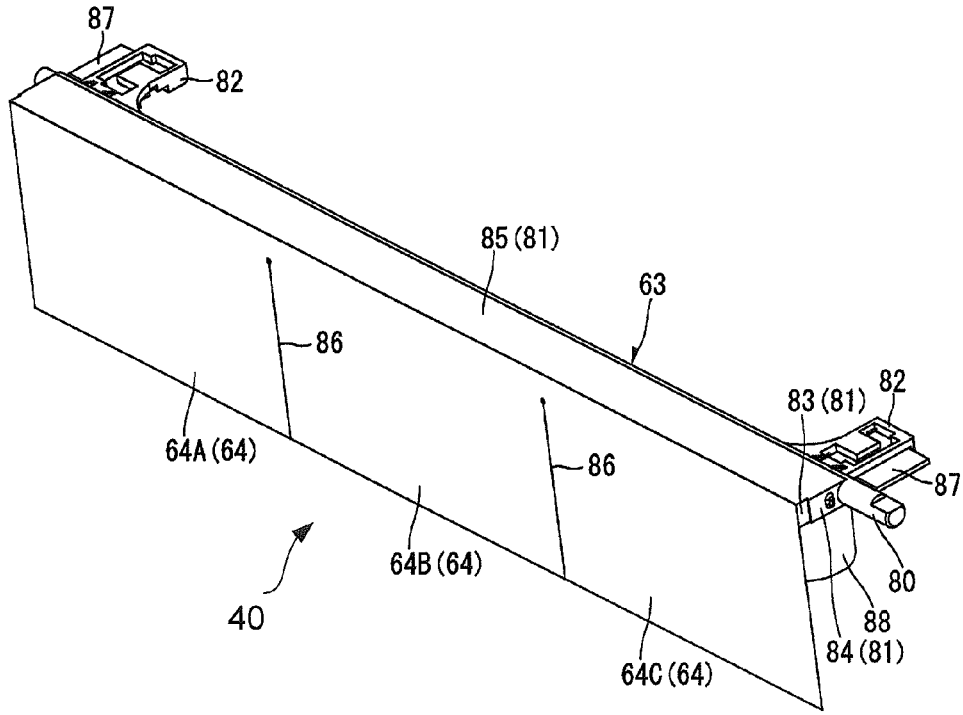
FIG. 4 is a perspective view of an agitator shown in FIG. 2 viewed from a film side.
Figure 5:
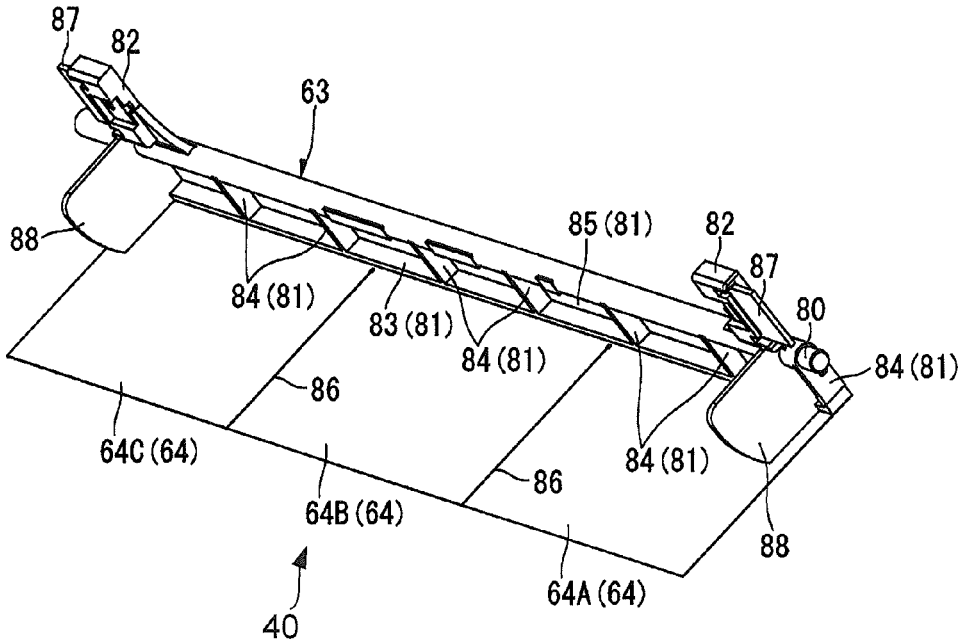
FIG. 5 is a perspective view of the opposite side of the agitator from that shown in FIG. 4.

The film 64 is shaped so that a length of the film 64, measured in the direction orthogonal to its longitudinal direction, is longer than a distance between the shaft body 80 and each point on the inner wall surface of the toner chamber 60 (FIG. 2).

In the agitator 40, support plates 88 serving as supporting members are provided at both ends of the film holding member 81 with respect to its longitudinal direction. Each support plate 88 is disposed between the outermost connecting rod 84 and the immediately inwardly adjacent connecting rod 84, and extends toward the free end of the film 64 in the direction orthogonal to the axial direction. Each support plate 88 is made of the same hard resin as that of the film holding member 81 and integrally formed with the film holding member 81.

A side of film 64 faces each support plate 88. Each support plate 88 contacts a side of film 64 near an outer end of the film 64, with respect to its longitudinal direction, in each end area 64A, 64C. Each support plate 88 may have a rectangular shape that may or may not be gently chamfered at its free end when viewed in the axial direction. A length of each support plate 88 measured in the direction orthogonal to the axial direction is shorter than the distance between the shaft body 80 and each point on the inner wall surface of the toner chamber 60 (FIG. 2).

Thus, as shown in FIG. 2, the film 64 is curved in the toner chamber 60 so that a surface of the film 64 opposite from the support plates 88 contacts the inner wall surface of the toner chamber 60. When the agitator rotating shaft 63 is rotated clockwise in FIG. 2, the film 64 is moved around the shaft body 80 of the agitator rotating shaft 63 while remaining in contact with the inner wall surface of the toner chamber 60.

Figure 6:
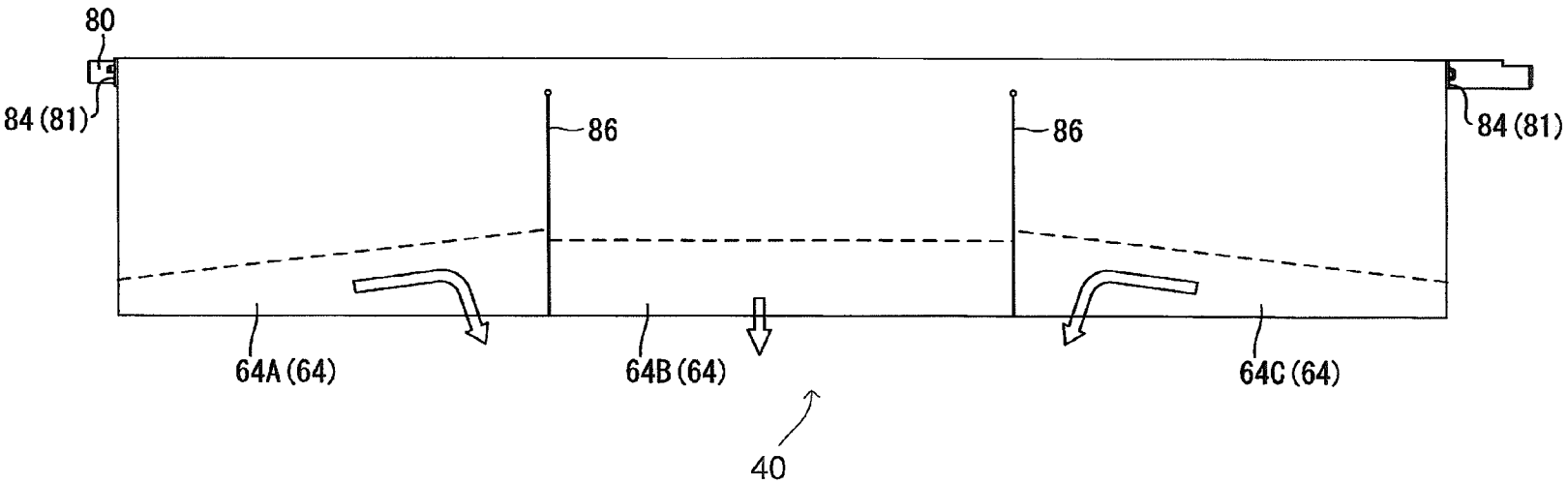
FIG. 6 is a front view of the agitator shown in FIG. 4.
Figure 7:
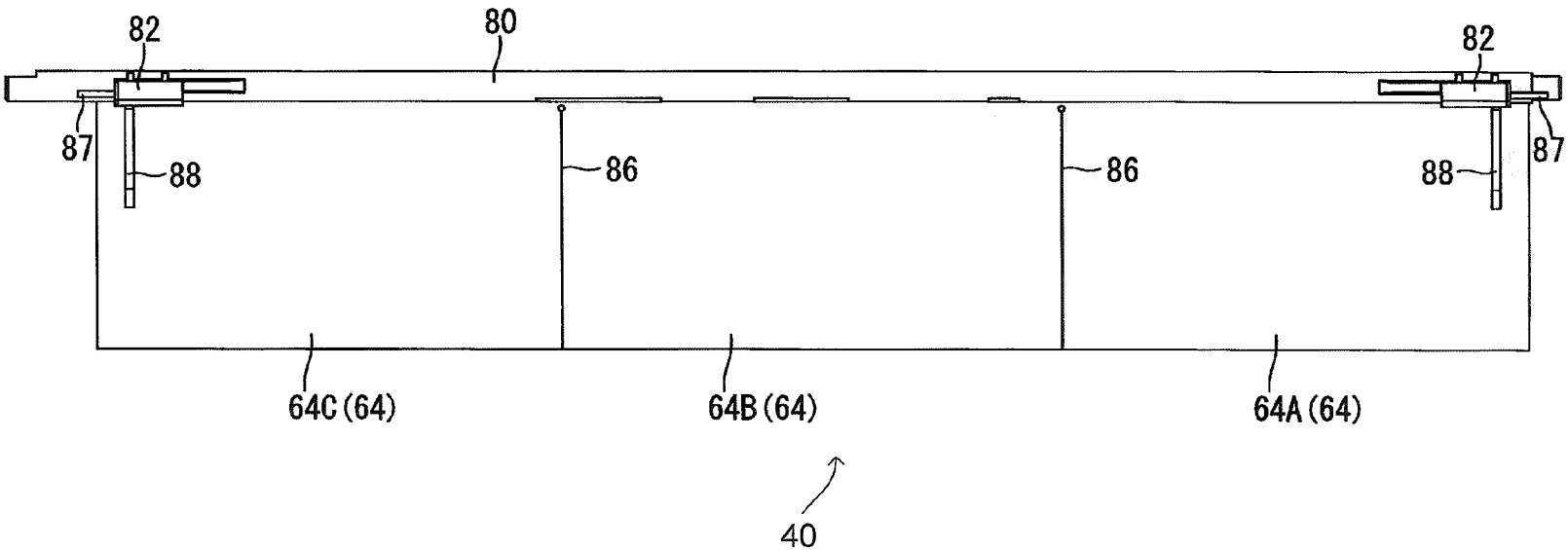
FIG. 7 is a rear view of the agitator shown in FIG. 4.

At this time, the film 64 is brought in a state shown by a broken line of FIG. 6 when viewed from a downstream side of the rotation direction. As the outer ends of the film 64, with respect to the longitudinal direction thereof, in both end areas 64A, 64C are supported by the support plates 88 from an upstream side of the rotation direction, the flexibility at the outer ends is small, and thus the outer ends move ahead of the inner ends of the areas 64A, 64C and the area 64B. In other words, as the inner ends of the areas 64A, 64C and the whole of the area 64B of the film 64 are not supported by the support plates 88, the flexibility at the inner ends of the areas 64A, 64C and the whole of the area 64B is great, and they move behind the outer ends in both end areas 64A, 64C. In still other words, in the film 64, stress (or resistance to toner) generated in the outer ends in both end areas 64A, 64C becomes greater than that generated in the inner ends of the areas 64A, 64C and the whole of the area 64B. Thus, as shown by arrows in FIG. 6, a flow of toner takes place inwardly in each end area 64A, 64C, and in a direction orthogonal to the axial direction in the area 64B. As a result, toner stored in the toner chamber 60 is agitated by the agitator 40 and collected in the middle of the toner chamber 60, and then efficiently fed to the developing chamber 61 via the toner supply opening 62.

The film 64 has the areas divided by the slits 86. Thus, stress produced in at least one of the areas can differ between one end and the other end of the area with respect to the axial direction, while the film 64 is rotated. Thus, the area produces a flow of toner having a direction going from a place where greater stress is produced to a place where less stress is produced. The other area enables toner to be moved in the direction orthogonal to the axial direction. Thus, the film 64 can maintain force enough to convey toner. That is, the film 64 can convey an adequate amount of toner while adding a component including the axial direction to a direction where toner is conveyed by the agitator 40. Thus, a thin layer of toner can be preferably formed on the developing roller 38, and the developing roller 38 can preferably develop the electrostatic latent image.

With a simple structure that the film 64 is provided with the support plates 88, special processing to the film 64 can be eliminated. Different levels of stress can be produced between the outer end and the inner end, with respect to the axial direction, in each end area 64A, 64C of the film 64 during rotation of the film 64.

The support plates 88 may be shorter than the film 64 in the direction orthogonal to the axial direction, so that the film 64 extends beyond the support plates 88 (or exists on a continuation of each support plate 88) and can be curved at the extended portion. Thus, the film 64 can be set so that the free end thereof can contact the inner wall surface of the toner chamber 60. The film 64 can slide on the inner wall surface of the toner chamber 64 upon the rotation, and thus can deliver better agitation of the toner.

The support plates 88 can be provided in the same number as the slits 86, and the number of the support plates 88 may be, for example one fewer than the number of the areas 64A, 64B, 64C divided by the slits 86. Thus, the area 64B, which is not supported by the support plates 88, can be provided. In the area 64B, which is not supported by the support plates 88, toner can be favorably moved in the direction orthogonal to the axial direction. Thus, the performance of the agitator 40 to convey toner can be further improved.

Figure 8:
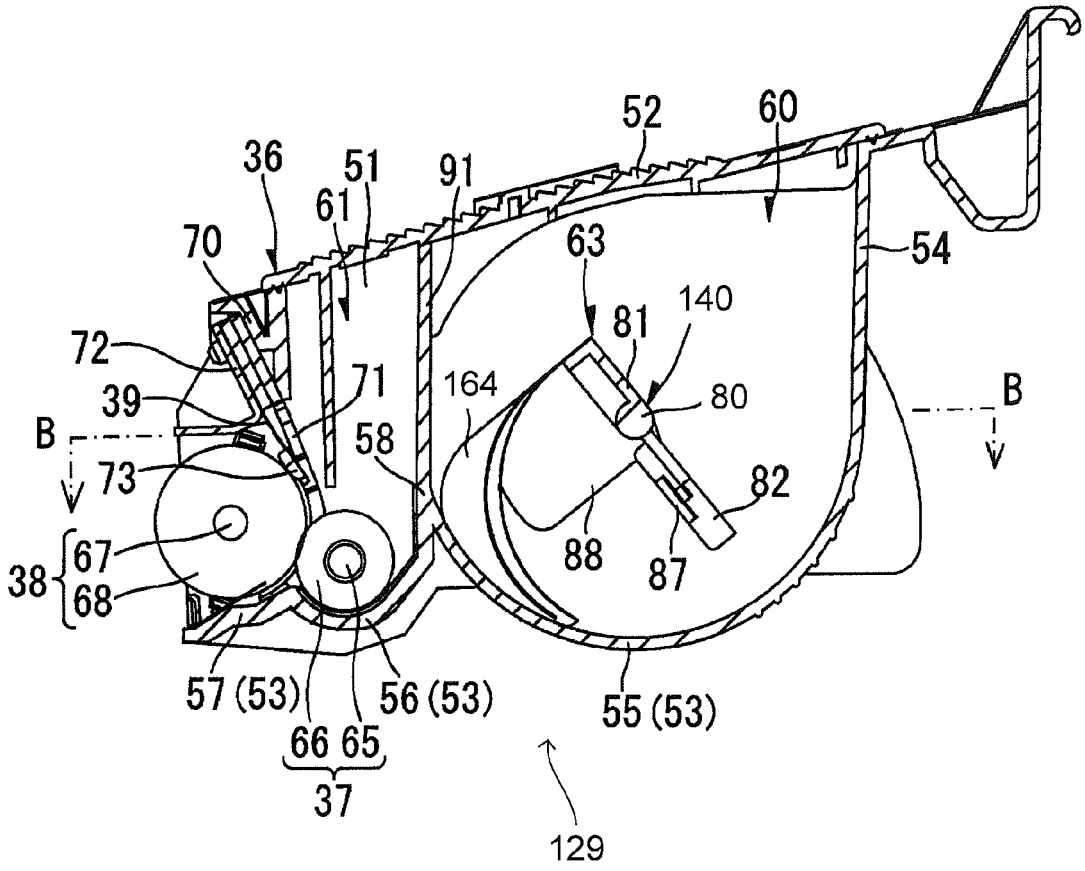
FIG. 8 is a sectional view of a developer cartridge according to another embodiment of the invention.
Figure 9:
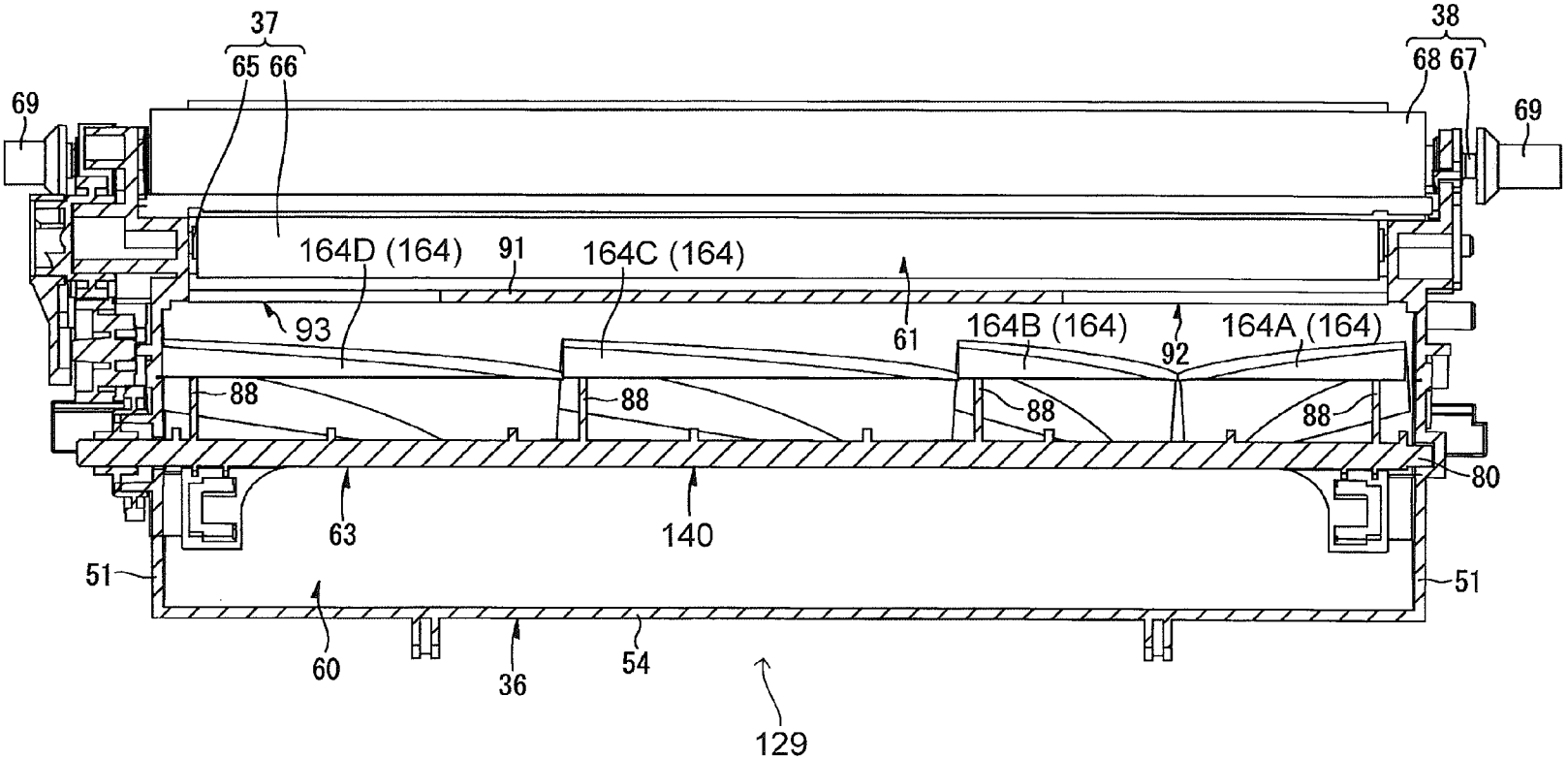
FIG. 9 is a sectional view of the developer cartridge taken along the line B-B of FIG. 8.
Figure 10:
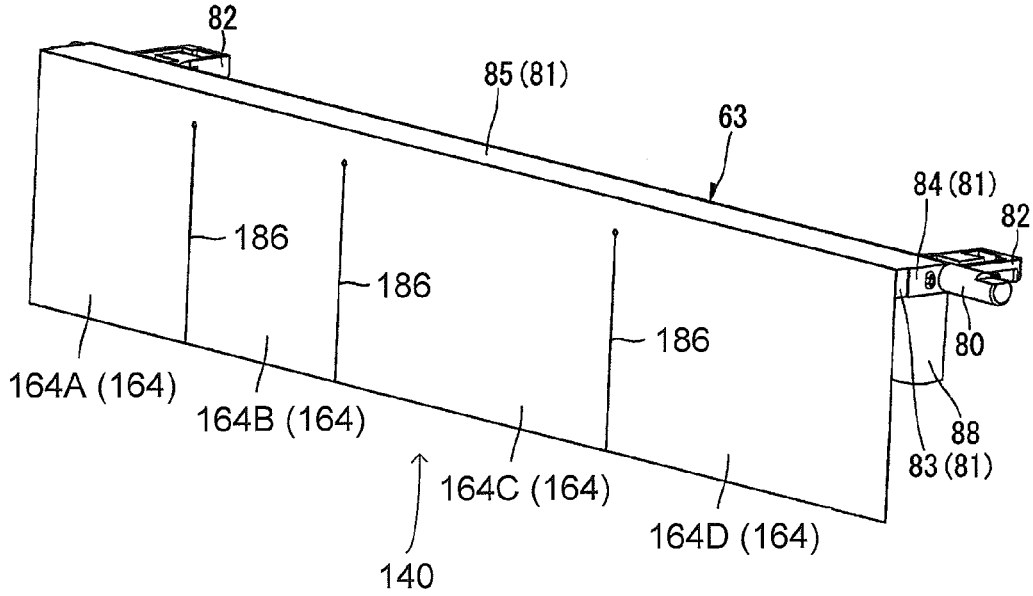
FIG. 10 is a perspective view of an agitator having three slits shown in FIG. 8 viewed from a film side.
Figure 11:
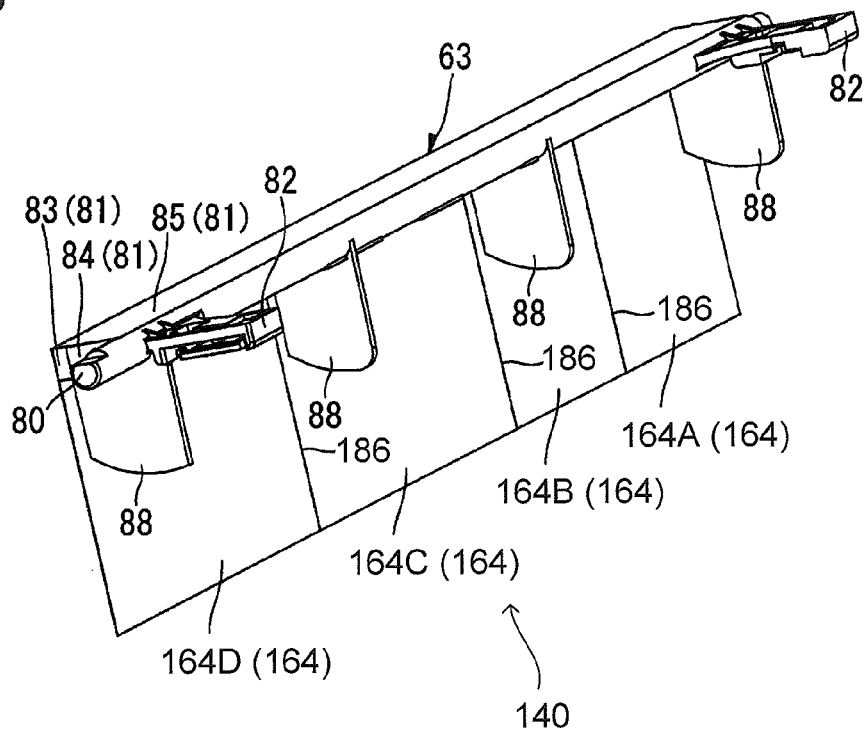
FIG. 11 is a perspective view of the opposite side of the agitator from that shown in FIG. 10.

A second embodiment of the invention will be described with reference to FIGS. 8 and 9. In FIGS. 8 and 9, a developing cartridge 129 is a variant of the developing cartridge 29 of the first embodiment, where parts substantially equivalent to those described above are denoted by the same reference numerals, and descriptions therefor will be omitted.

The developing cartridge 129 includes a partition wall 91 configured to partition the internal space of the case 36 into the toner chamber 60 and the developing chamber 61. The partition wall 91 extends vertically in the case 36, so that a bottom end of the partition wall 91 reaches the boundary portion 58 between the front-side bottom wall 55 and the middle bottom wall 56, and a top end of the partition wall 91 reaches the inner wall surface (bottom surface) of the top wall 52. As shown in FIG. 9, the partition wall 91 is disposed in a middle portion of the case 36 with respect to the longitudinal direction thereof, and spaces are provided outside both ends of the partition wall 91 between both sidewalls 51. The spaces may open vertically in the case 36. One of the spaces provided facing the area 164A functions as a toner supply opening 92 through which toner stored in the toner chamber 60 is fed to the developing chamber 61. The other space provided facing the area 164D functions as a toner return opening 93 through which toner excessively fed in the developing chamber 61 is returned to the toner chamber 60.

With reference to FIGS. 10 to 13, an agitator 140 included in the developer cartridge 129 of the second embodiment shown in FIG. 8 will be described. In FIGS. 10 to 13, parts substantially equivalent to those described above are denoted by the same reference numerals, and descriptions therefor will be omitted. In FIGS. 10 to 13, the wipers 87 are not shown.

A film 164 is formed with three slits 186 extending from a free end of the film 164 near to the film adhering plate 83. Two of the three slits 86 are made in positions where the film 164 is divided into three equal areas in the axial direction, and the remaining one is made in a position where one of the three equal areas located on one end is divided into two equal areas. With the arrangement of the slits 186, the film 164 is divided into two narrow areas 164A, 164B, which are relatively narrow with respect to the axial direction, and two broad areas 164C, 164D, which are relatively broad with respect to the axial direction.

The agitator 140 is provided with four support plates 88. Two of the four support plates 88 are disposed on both ends of the film holding member 81 with respect to the longitudinal direction thereof, facing outer ends in the corresponding end areas 164A, 164D of the film 164, and extending in a direction orthogonal to the axial direction from the film holding member 81 toward the free end of the film 164. The remaining two support plates 88 are disposed in positions facing the ends on the area 164D side in the areas 164B, 164C, and extending in the direction orthogonal to the axial direction from the film holding member 81 toward the free end of the film 164.

With this structure, as shown in FIG. 8, the film 164 is curved in the toner chamber 60 so that a surface of the film 164 opposite from the support plates 88 contacts the inner wall surface of the toner chamber 60. When the agitator rotating shaft 63 is rotated clockwise in FIG. 8, the film 164 is moved around the shaft body 80 of the agitator rotating shaft 63 while remaining in contact with the inner wall surface of the toner chamber 60.

Figure 12:
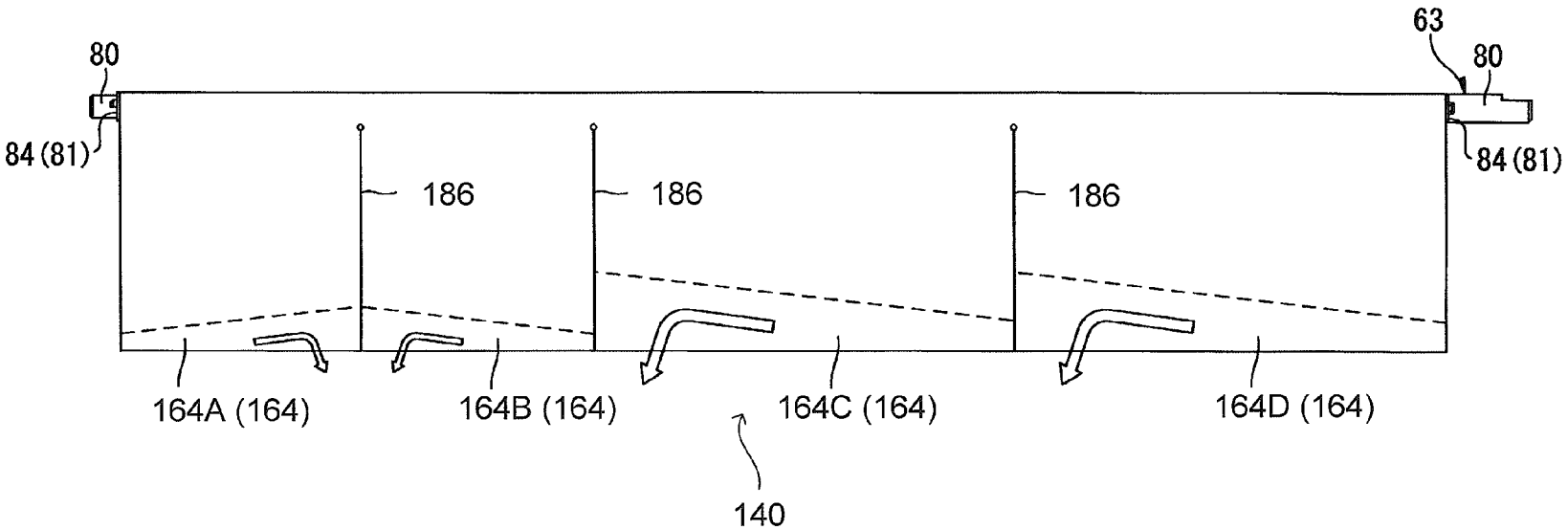
FIG. 12 is front view of the agitator shown in FIG. 10.
Figure 13:
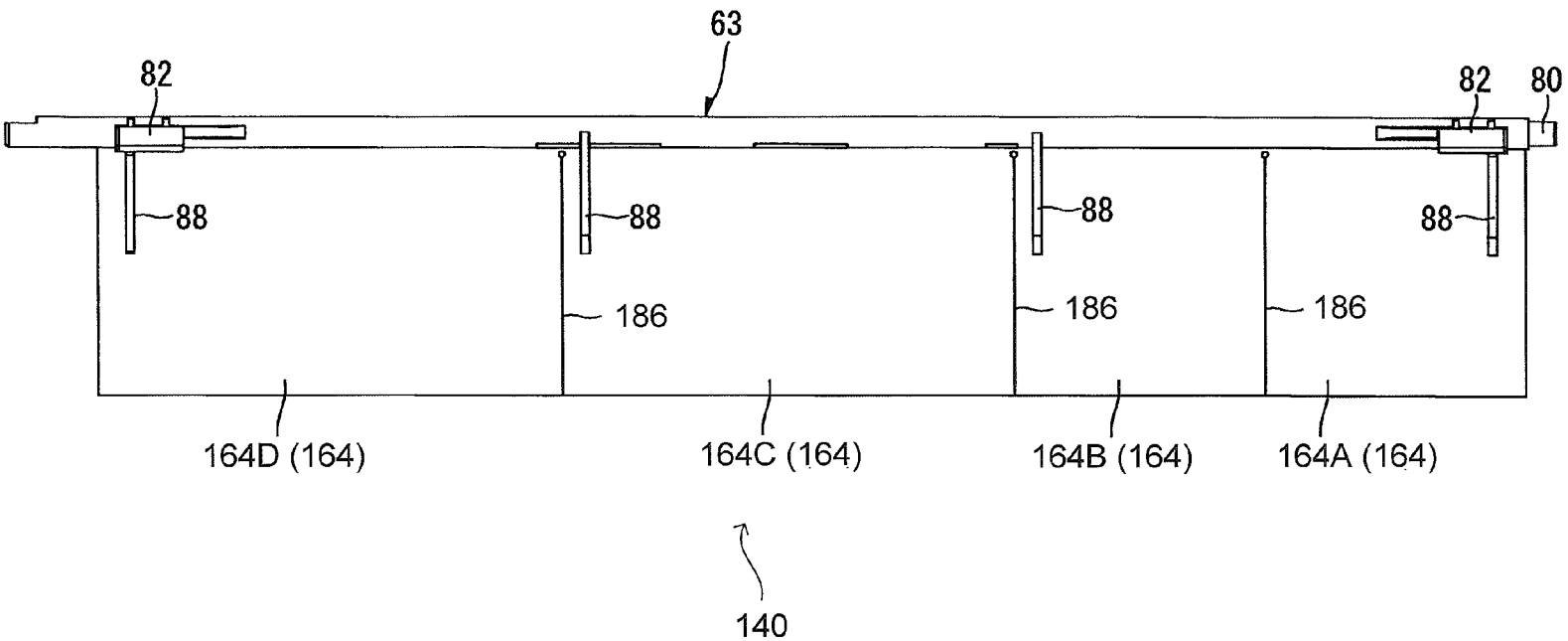
FIG. 13 is a rear view of the agitator shown in FIG. 10.
Figure 14:
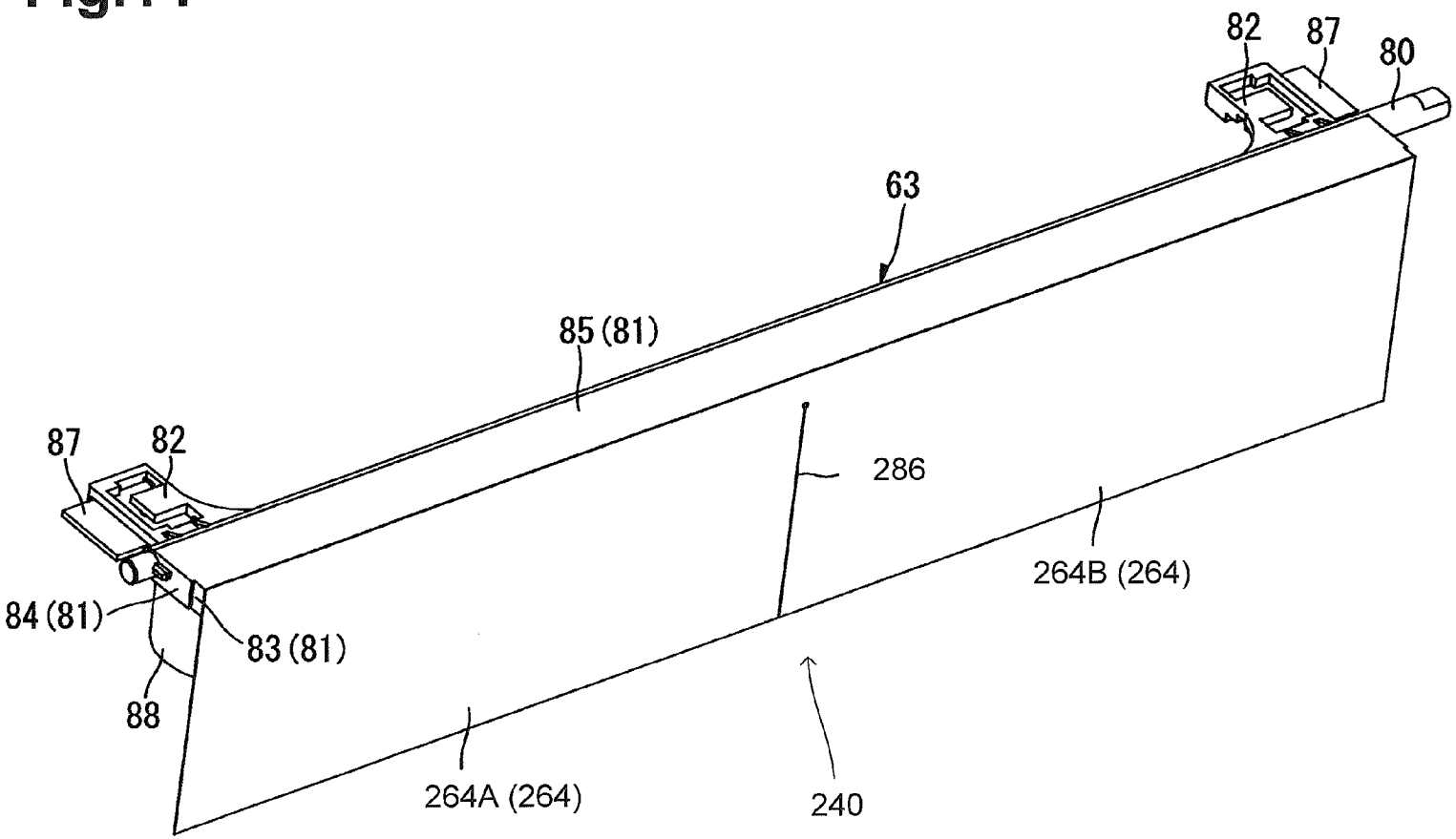
FIG. 14 is a perspective view of an agitator having a slit viewed from a film side according to another embodiment of the invention.
Figure 15:
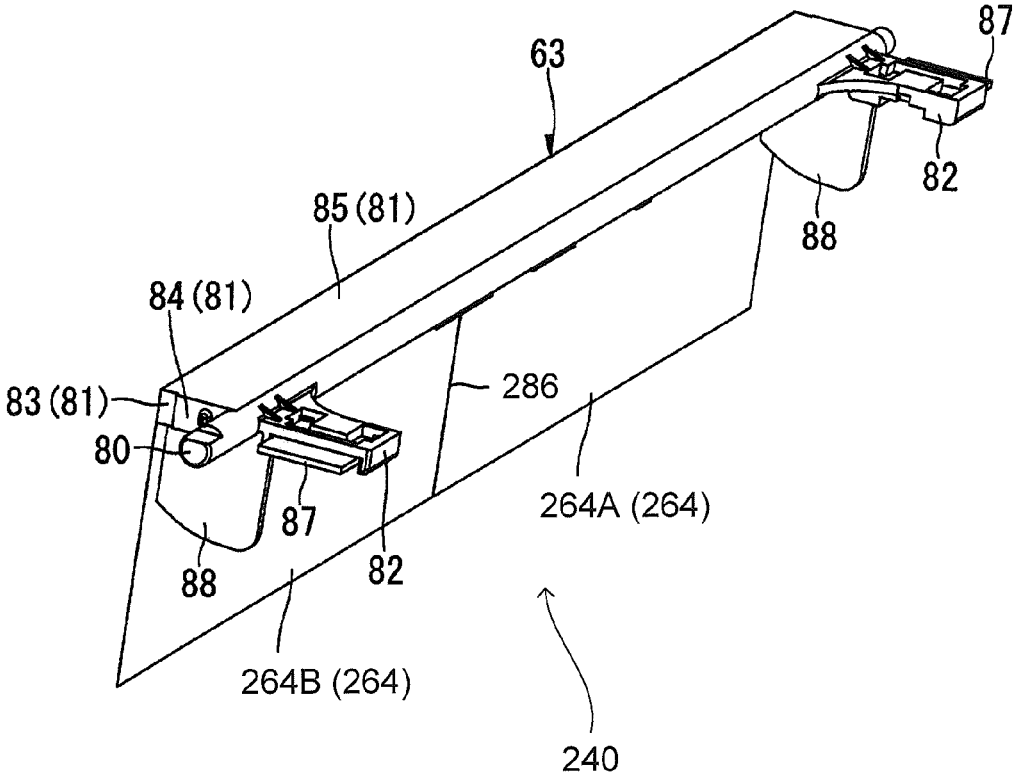
FIG. 15 is a perspective view of the opposite side of the agitator from that shown in FIG. 14.

At this time, the film 164 is brought into a state shown by a broken line of FIG. 12 when viewed from a downstream side of the rotation direction. In the areas 164A, 164B of the film 164, as the respective outer ends, with respect to the axial direction, are supported by the support plates 88, they may receive relatively small deflections, and thus move ahead of the inner ends. In other words, in the areas 164A, 164B of the film 164, as the inner ends are not supported by the support plates 88, they may receive relatively great deflections, and lag behind the outer ends. In other words, in the areas 164A, 164B of the film 164, stress generated in the outer ends becomes greater than stress generated in the inner ends. In the areas 164C, 164D, as ends on the area 164D side (as opposed to the 164A side) are supported by the support plates 88, they receive relatively small deflection, and thus move ahead of the opposite ends on the area 164A side. In other words, in the areas 164C, 164D, as the ends on the area 164A side are not supported by the support plates 88, they receive relatively greater deflections, and thus lag behind the ends on the area 164D side. In still other words, in the areas 164C, 164D, stress generated on the face of film 164 on the area 164D side increases greater than stress generated on the face of film 164 on the area 164A side.

Thus, as shown by arrows in FIG. 12, in the vicinity of each area 164A, 164B, a flow of toner directed between the areas 164A, 164B takes place. In the vicinity of each area 164C, 164D, a flow of toner directed from the area 164D to the area 164A occurs. Thus, toner stored in the toner chamber 60 is mixed by the agitator 140, collected on moving paths in the areas 164A, 164B, and fed in the direction orthogonal to the axial direction toward the developing chamber 61. With this structure, toner stored in the toner chamber 60 can be efficiently fed to the developing chamber 61 via the toner supply opening 92. Excess toner fed to the developing chamber 61 is returned to the toner chamber 60 via the toner return opening 93.

A third embodiment of the invention will be described with reference to FIGS. 14 to 17. In FIGS. 14 to 17, an agitator 240 is a variant of the agitator 40 of the first embodiment shown in FIGS. 4 to 7, parts substantially equivalent to those described above are denoted by the same reference numerals, and descriptions therefor will be omitted.

The agitator 240 may be used instead of the agitator 40 of the first embodiment. In the agitator 240 of the third embodiment, a film 264 is formed with a slit 286 extending from the free end of the film 264 to at least near to the film adhering plate 83. The free end of the film 264 is divided into two areas 264A, 264B, which are substantially equal in the axial direction.

In the agitator 240, support plates 88 are disposed on both ends of the film holding member 81 with respect to its axial direction. The support plates 88 extend in the direction orthogonal to the axial direction from the film holding member 81 to the free end of the film 264. The support plates 88 face the outer ends of the areas 264A, 264B.

Thus, the film 264 may be curved in the toner chamber 60 (FIG. 2) so that a surface of the film 264 opposite from the support plates 88 contacts the inner wall surface of the toner chamber 60. When the agitator rotating shaft 63 is rotated, the film 264 is moved around the shaft body 80 of the agitator rotating shaft 63 while remaining in contact with the inner wall surface of the toner chamber 60.

Figure 16:
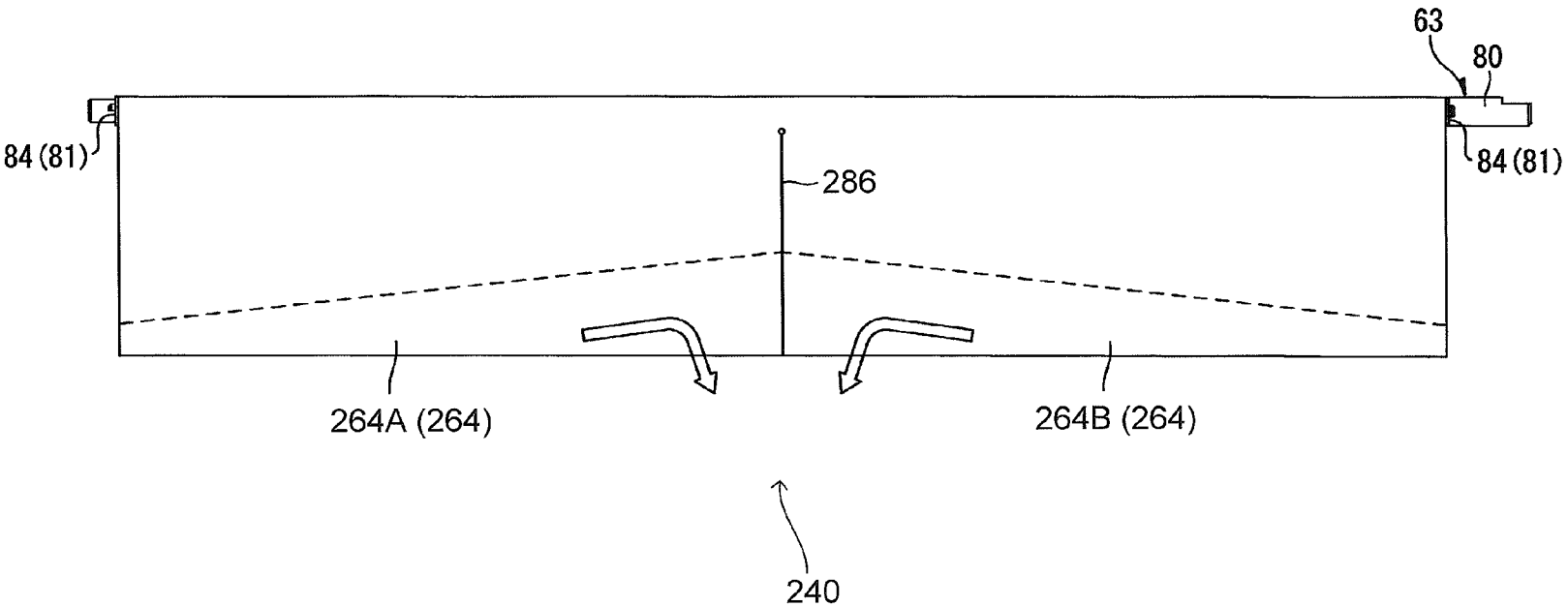
FIG. 16 is a front view of the agitator shown in FIG. 14.
Figure 17:
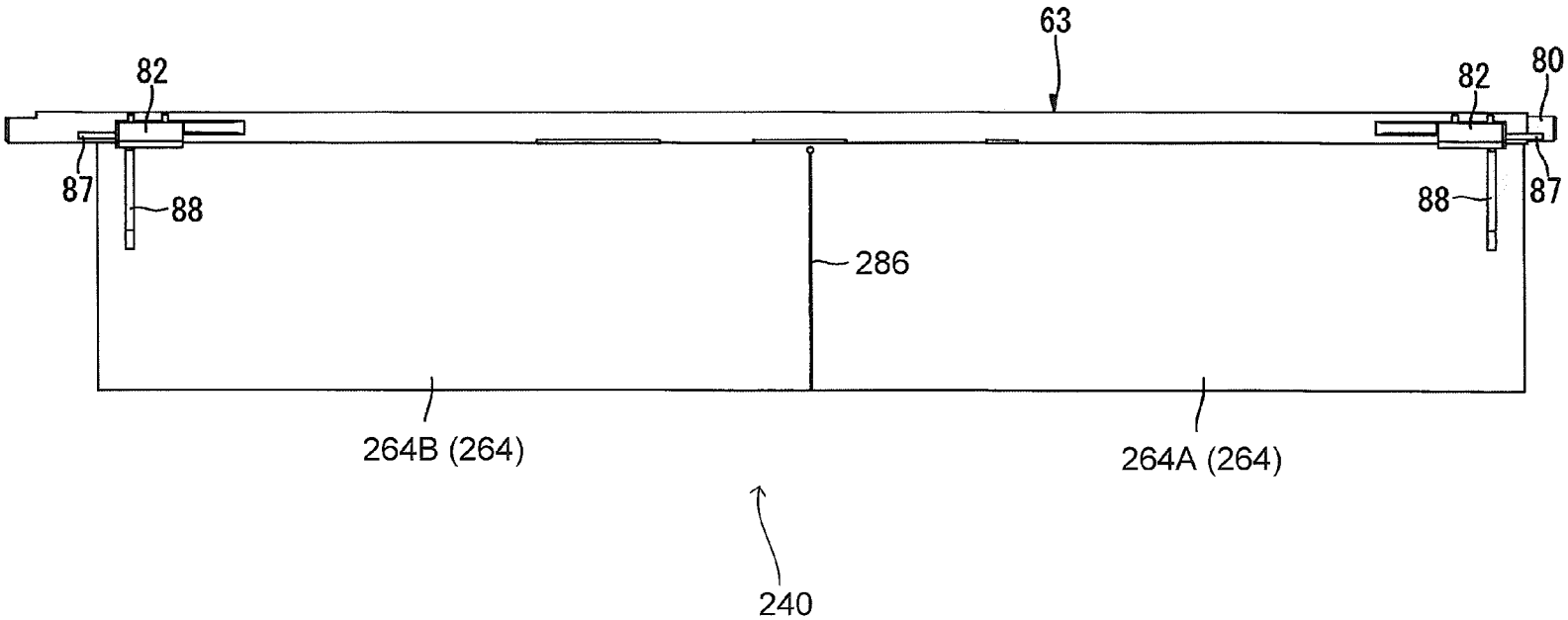
FIG. 17 is a rear view of the agitator shown in FIG. 14.

At this time, the film 264 is brought in a state shown by a broken line of FIG. 16 when viewed from a downstream side of the rotation direction. In each area 264A, 264B, the outer end with respect to the axial direction is supported by the support plate 88 from an upstream side of the rotation direction, it receives a relatively small deflection, and thus moves ahead of the inner end. In other words, in each area 264A, 264B, as the inner end is not supported by the support plate 88, it receives a relatively greater deflection, and thus moves behind the outer end. In other words, in each area 264A, 264B, stress (or resistance to toner) generated in the outer end becomes greater than that in the inner end.

Thus, as shown by arrows in FIG. 16, a flow of toner directed between the areas 264A, 264B takes place in the toner chamber 60. As a result, toner stored in the toner chamber 60 is mixed by the agitator 240 and moves toward the middle of the toner chamber 60, and then is efficiently fed to the developing chamber 61 via the toner supply opening 62.

Figure 18:
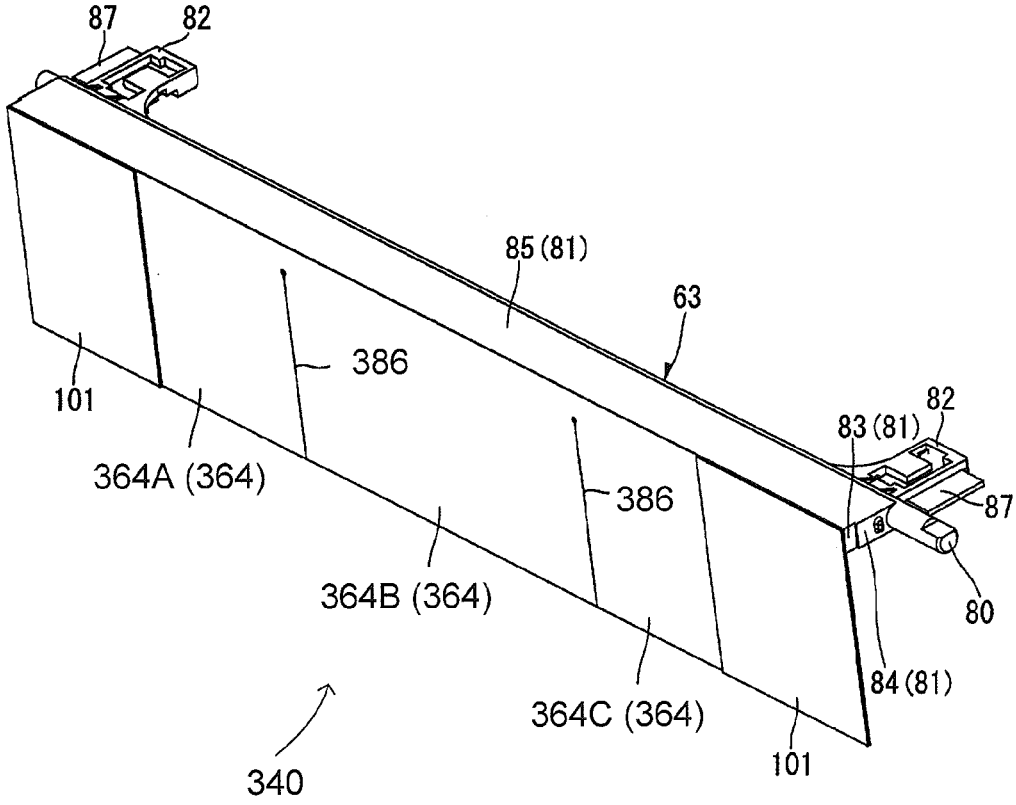
FIG. 18 is a perspective view of an agitator to which rectangle shaped thickness regulating sheets are adhered, viewed from a film side, according to another embodiment of the invention.

A fourth embodiment of the invention will be described with reference to FIG. 18. In FIG. 18, an agitator 340 is a variant of the agitator 40 of the first embodiment shown in FIGS. 4 to 7, parts substantially equivalent to those described above are denoted by the same reference numerals, and descriptions therefor will be omitted.

The agitator 340 may be used instead of the agitator 40 of the first embodiment. The agitator 340 further includes thickness regulating sheets 101 bonded onto both end areas 364A, 364C of the film 364 in addition to the structure of the agitator 40 of the first embodiment. The thickness regulating sheets 101 function as thickness regulating members.

The thickness regulating sheets 101 are made of the same film material as the film 364 with the same thickness as the film 364. Film 364 may have slits 386. Each thickness regulating sheet 101 is rectangular shaped so that it may have half the width of the corresponding one of the areas 364A, 364C, and has the same length as the film 364 in the direction orthogonal to the axial direction. Each thickness regulating sheet 101 is bonded at the outer end of the corresponding one of the areas 364A, 364C, with respect to the axial direction, on a surface of the film 364 opposite from the support plates 88.

With this structure, during rotation of the film 364, greater stress can be produced in outer ends of both end areas 364A, 364C of the film 364, with respect to the axial direction. Thus, the stress can be produced differently in size between the outer ends and the inner ends of both end areas 364A, 364C. As a result, the performance of the agitator 340 to convey toner can be further improved.

The support plates 88 may be omitted from the agitator 340 shown in FIG. 18. Even in this case, the agitator 340 can exhibit substantially similar effects as the agitator 40 of the first embodiment.

In the fourth embodiment, the thickness regulating sheets 101 are attached to the film 364 to change stress to be produced therein. However, instead of the thickness regulating sheets 101, thickness of the film 340 may be changed in the areas 364A and 364C.

Figure 19:
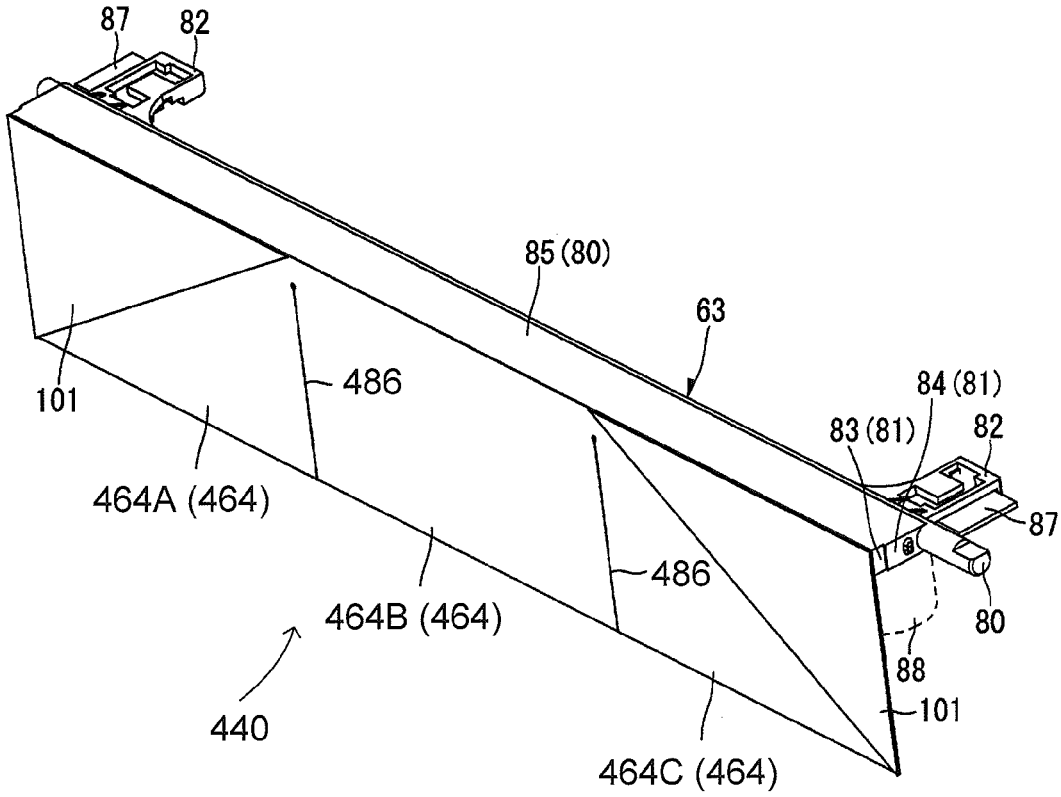
FIG. 19 is a perspective view of an agitator to which right triangle shaped thickness regulating sheets are adhered, viewed from a film side, according to another embodiment of the invention.
Figure 20:
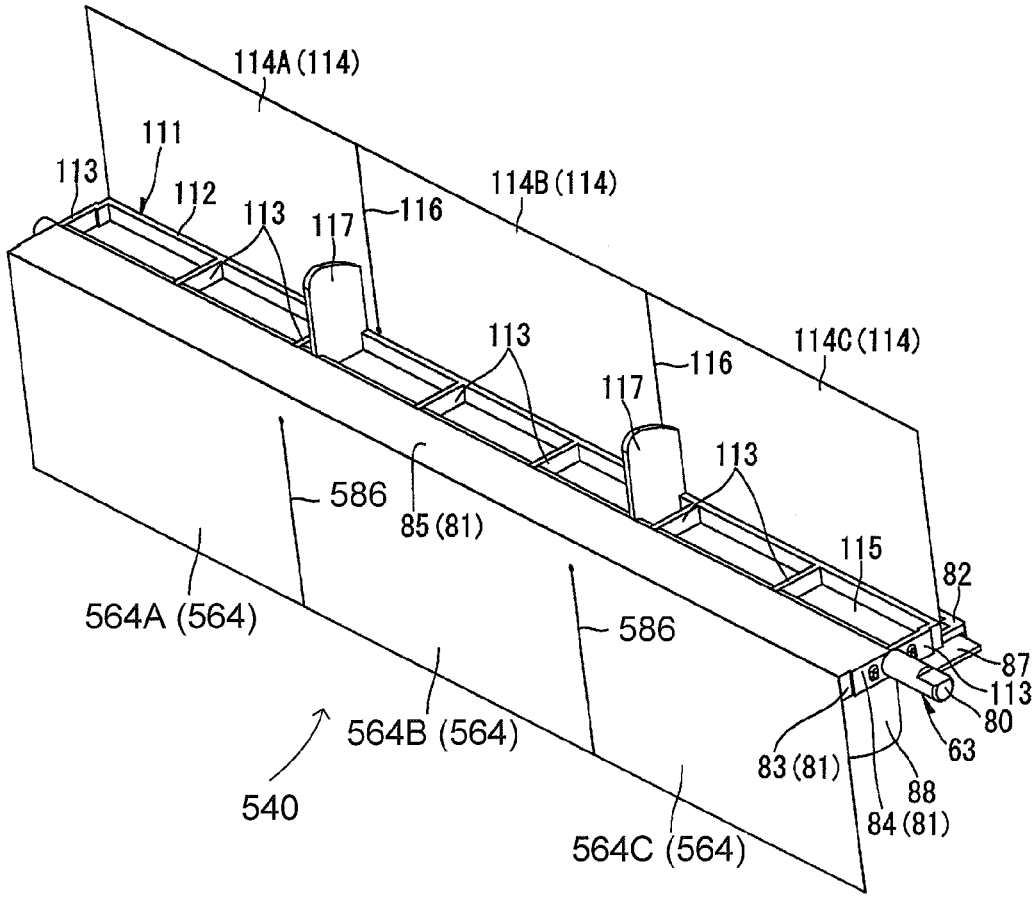
FIG. 20 is a perspective view of an agitator including two films according to another embodiment of the invention.
Figure 21:
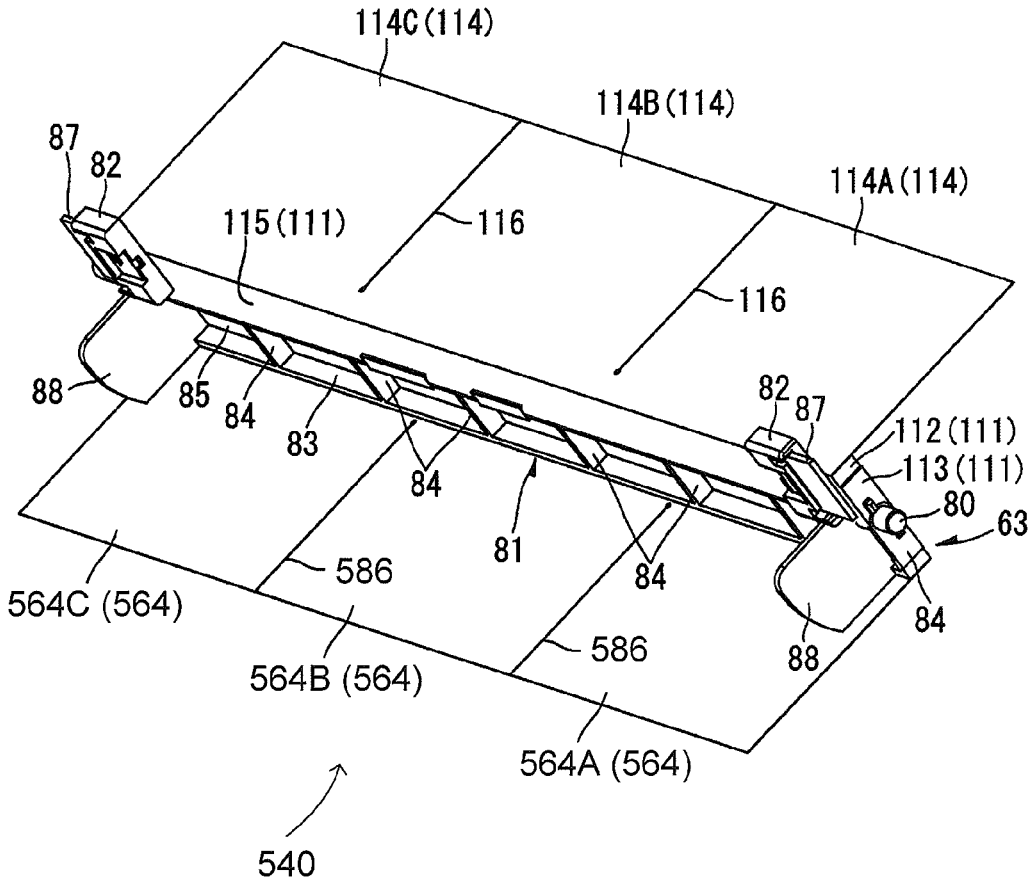
FIG. 21 is a perspective view of the opposite side of the agitator from that shown in FIG. 20.

A fifth embodiment of the invention will be described with reference to FIG. 19. In FIG. 19, an agitator 440 is a variant of the agitator 40 of the first embodiment shown in FIGS. 4 to 7, parts substantially equivalent to those described above are denoted by the same reference numerals, and descriptions therefor will be omitted.

The agitator 440 may be used instead of the agitator 40 of the first embodiment. In the agitator 440, the thickness regulating sheets 101 are substantially triangular shaped. Each thickness regulating sheet 101 is configured so that one side of two sides orthogonal to each other has the same width as the width of the corresponding area 464A, 464C in the axial direction, and the other side has the same length as the length of the film 464 in the direction orthogonal to the axial direction. The film 464 may have slits 486. Each thickness regulating sheet 101 is disposed in the corresponding area 464A, 464C so that the one end is aligned with the base end of the film 464 and the other end is flush with the outer edge of the corresponding area 464A, 464C with respect to the axial direction. Each thickness regulating sheet 101 can be affixed to a surface of the film 464 opposite from the support plates 88.

With this structure, upon the rotation of the film 464, greater stress can be produced on the faces of the outer ends in the areas 464A, 464C of the film 464. In addition, stiffness in the inner ends of the areas 464A, 464C of the film 464 at the base end can be improved. Thus, the performance of the agitator 440 to convey toner can be improved.

The thickness regulating sheets 101 alone are enough to produce greater stress in the outer ends than in the inner ends of the areas 464A, 464C upon the rotation of the agitator 440. Thus, the support plates 88 may be omitted from the agitator 440 shown in FIG. 19. Even in this case, the agitator 440 can exhibit substantially similar effects as the agitator 40 of the first embodiment.

In the fifth embodiment, the thickness regulating sheets 101 are attached to the film 464 to change stress to be produced therein. However, instead of the thickness regulating sheets 101, thickness of the film 464 may be changed in the areas 464A and 464C.

A sixth embodiment of the invention will be described with reference to FIGS. 20 to 23. In FIGS. 20 to 23, an agitator 540 is a variant of the agitator 40 of the first embodiment shown in FIGS. 4 to 7, parts substantially equivalent to those described above are denoted by the same reference numerals, and descriptions therefor will be omitted.

The agitator 540 may be used instead of the agitator 40 of the first embodiment. The agitator rotating shaft 63 of the agitator 540 includes a round rod-like shaft body 80, a film holding member 81, a second film holding member 111, and a wiper holding member 82. The shaft body 80 extends in the longitudinal direction of the case 36. The film holding member 81 is fixed on one side of the shaft body 80 with respect to its radial direction. The second film holding member 111 is fixed on the other side of the shaft body 80, which is opposite from the film holding member 81. The wiper holding member 82 is fixed to the second film holding member 111.

As with the film 64 of the first embodiment, a film 564 is attached to the film adhering plate 83 of the film holding member 81. The film 564 is divided into three areas 564A, 564B, 564C partitioned by two slits 586.

The second film holding member 111 includes a film adhering plate 112, a plurality of connecting rods 113, and a closing plate 115. The film adhering plate 112 is a thin-plate like member extending in the axial direction of the shaft body 80. The connecting rods 113 are spaced in the axial direction of the shaft body 80, and disposed between the film adhering plate 112 and the shaft body 80. The closing plate 115 is provided so as to close a space between the film adhering plate 112 and the shaft body 80.

The film adhering plate 112 is disposed symmetrical to the film adhering plate 83 of the film holding member 81 on the shaft body 80 and so that one side of the film adhering plate 112 is parallel to the shaft body 80. The other side of the film adhering plate 112, which is far from the shaft body 80, is a surface to which a film 114 is adhered. The film 114 functions as a flexible member.

The film 114 is made of polyethylene terephthalate (PET) and has a rectangular shape extending in the axial direction of the shaft body 80. A base end of the film 114, with respect to the direction orthogonal to the axial direction of the shaft body 80, is adhered to the film adhering plate 112. The film 114 and the film 564, held by the film holding member 81, extend in opposite directions from each other.

The film 114 is formed with two slits 116. Each slit 116 extends from a free end of the film 114 (where the film 114 is not adhered to the film adhering plate 112) to near the film adhering plate 112. The free end of the film 114 is divided into three areas 114A, 114B, 114C, which are substantially equal in the axial direction.

The film 114 is shaped so that a width of the film 114, which is a distance measured in the direction orthogonal to the axial direction, is longer than a distance between the shaft body 80 of the agitator rotating shaft 63 and the each point on the inner wall surface of the toner chamber 60 (FIG. 2).

Support plates 117 are disposed in a middle portion of the film holding member 111 so as to face the inner ends of the areas 114A, 114C with respect to the axial direction. The support plates 117 function as a supporting member and extend toward the free end of the film 114 in the direction orthogonal to the axial direction. The support plates 117 are made of the same hard resin as that of the second film holding member 111 and shaped integrally with the second holding member 111. The support plates 117 have a rectangular shape gently chamfered at their free ends when viewed in the axial direction. A length of each support plate 117 in the direction orthogonal to the axial direction is shorter than the distance between the shaft body 80 and each point on the inner wall surface of the toner chamber 60 (FIG. 2).

With this structure, the films 564, 114 are curved in the toner chamber 60 so that a surface of each film 564, 114 opposite form the shaft body 80 contacts the inner wall surface of the toner chamber 60. When the agitator rotating shaft 63 is rotated, the films 564, 114 are moved around the shaft body 80 of the agitator rotating shaft 63 while remaining contacting the inner wall surface of the toner chamber 60.

Figure 22:
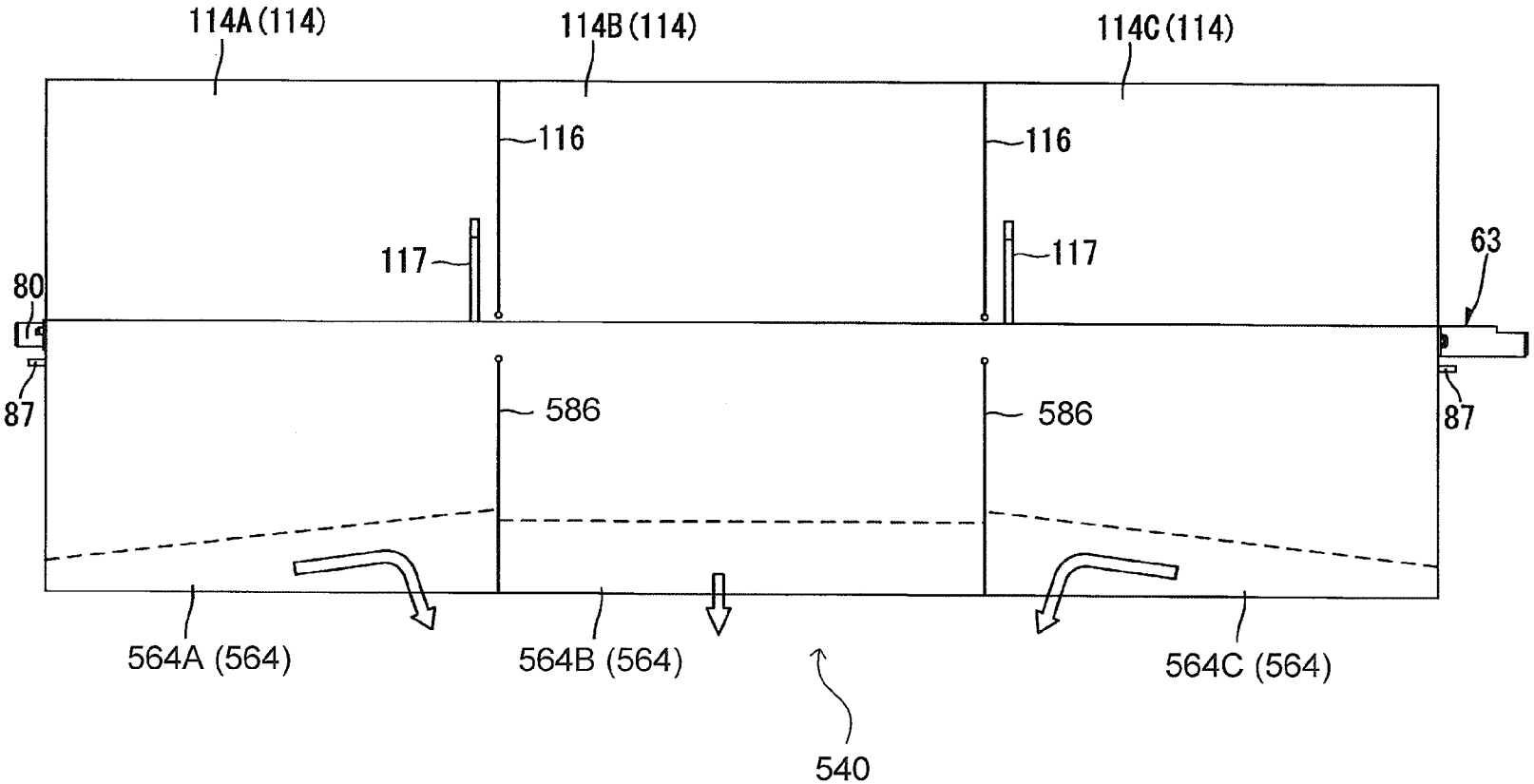
FIG. 22 is a front view of the agitator shown in FIG. 20.
Figure 23:
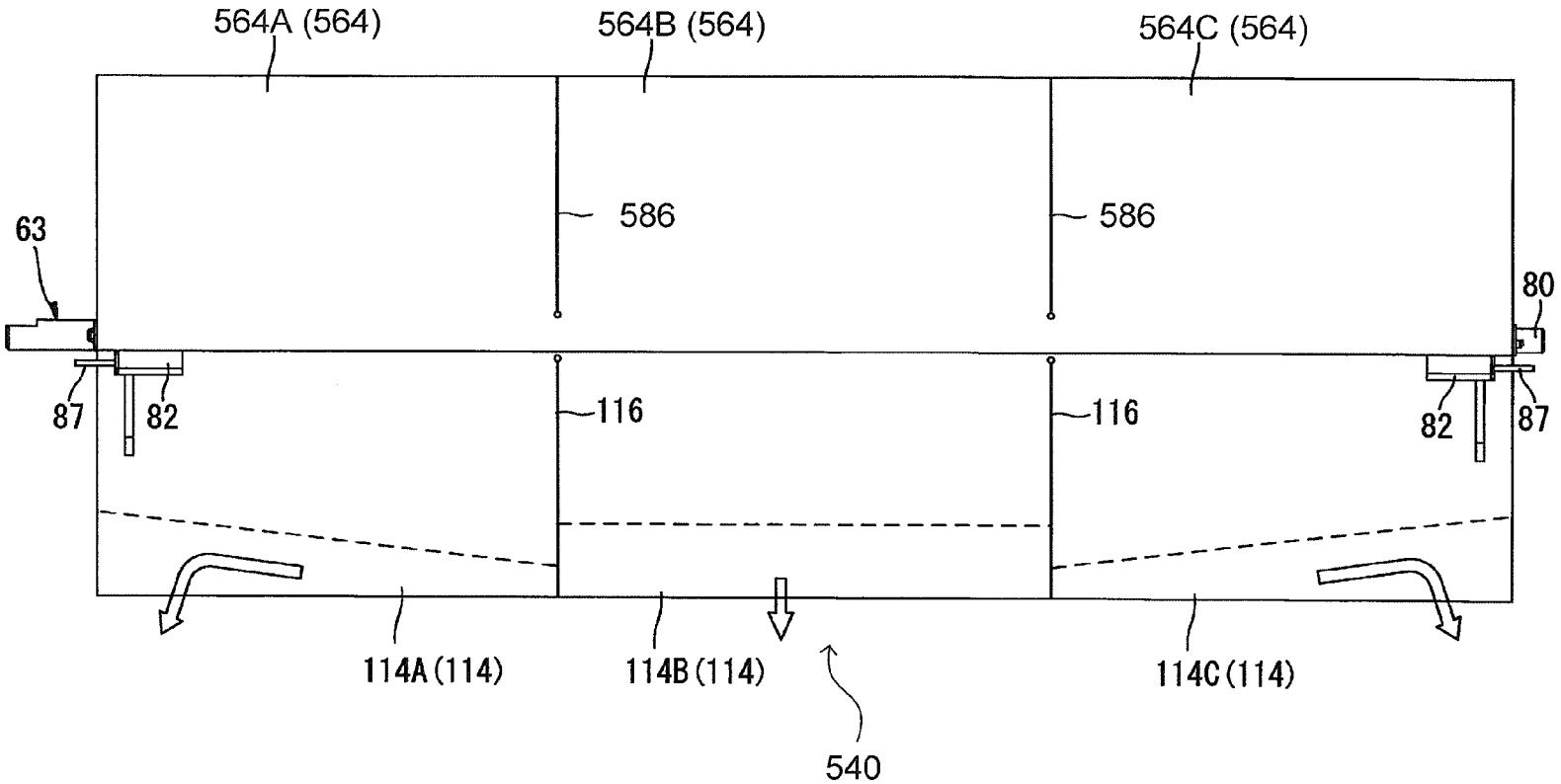
FIG. 23 is a rear view of the agitator shown in FIG. 20.

At this time, the film 564 is brought in a state shown by a broken line of FIG. 22 when viewed from a downstream side of the rotation direction. As the outer ends of the areas 564A, 564C of the film 564, with respect to the axial direction, are supported by the support plates 88 from an upstream side of the rotation direction, they receive less deflection, and thus move ahead of the inner ends of the areas 564A, 564C and the area 564B. On the other hand, the film 114 is brought in a state shown by a broken line of FIG. 23 when viewed from the downstream side of the rotation direction. As the inner ends of the areas 114A, 114C, with respect to the axial direction, are supported by the support plates 117 from the upstream side of the rotation direction, they receive less deflection, and thus move ahead of the outer ends of the areas 114A, 114C, and the area 114B. In other words, as the outer ends of the areas 114A, 114C and the area 114B of the film 114 are not supported by the support plates 117, they receive greater deflection, and lags behind the inner ends of the areas 114A, 114C. In still other words, in the film 114, stress (or resistance to toner) generated at the inner ends of the areas 114A, 114C becomes greater than that generated in the outer ends of the areas 114A, 114C and the area 114B.

Thus, as shown by arrows in FIG. 22, in the vicinity of each area 564A, 564C of the film 564, a flow of toner directed from the outer end to the inner end in the axial direction takes place. In the vicinity of the area 564B, a flow of toner directed in the direction orthogonal to a surface of the area 564B axial direction takes place. On the other hand, as shown by arrows in FIG. 23, in the vicinity of each area 114A, 114C, a flow of toner directed from the inner end to the outer end takes place. In the vicinity of the area 114B, a flow of toner directed in the direction orthogonal to a surface of the area 114B takes place.

As a result, toner is collected at the middle in the toner chamber 60 by the film 564, and dispersed in the longitudinal direction of the toner chamber 60 by the film 117. Thus, the agitator 540 of FIGS. 20 to 23 can retain the performance to convey toner same or more than that of the agitator 40 of the first embodiment, as well as disperse toner stored in the toner chamber 60 in the longitudinal direction of the toner chamber 60. With this structure, the performance to mix toner can be improved.

Figure 24:
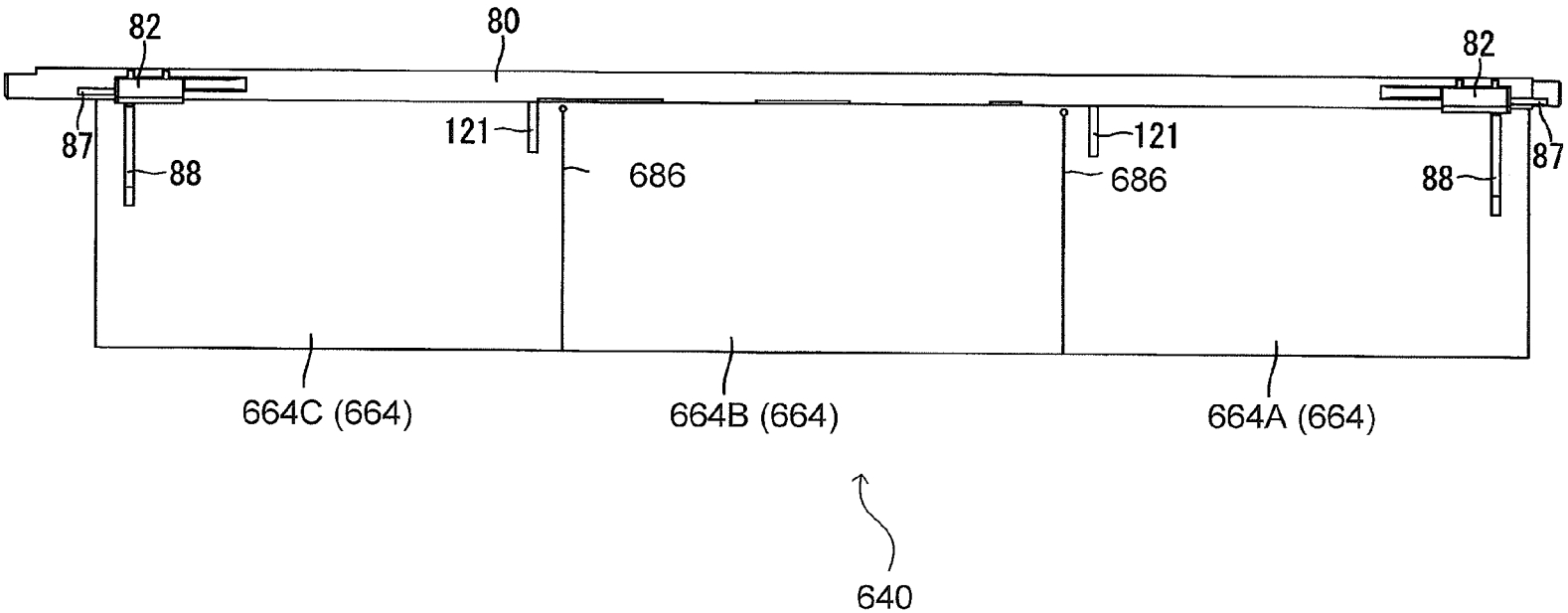
FIG. 24 is a rear side of an agitator having different length supporting plates in each area according to another embodiment of the invention.

A seventh embodiment of the invention will be described with reference to FIG. 24. In FIG. 24, an agitator 640 is a variant of the agitator 40 of the first embodiment shown in FIGS. 4 to 7, parts substantially equivalent to those described above are denoted by the same reference numerals, and descriptions therefor will be omitted.

The agitator 640 may be used instead of the agitator 40 of the first embodiment. The agitator 640 further includes a film 664 with slits 686 and support plates 121 in addition to the structure of the agitator 40 of the first embodiment. The support plates 121 are disposed in a middle portion in the axial direction of the film holding member 81 to face the inner ends of end areas 664A, 664C of the film 664. The support plates 121 extend in the direction orthogonal to the axial direction from the film holding member 81 to the free end of the film 564.

The support plates 121 are made of the same hard resin as the film holding member 81 and are shaped integrally with the film holding member 81. Each support plate 121 has a substantially rectangular shape that may be gently chamfered at its free end when viewed in the axial direction. A length of each support plate 121 is shorter than the support plate 88 with respect to the direction orthogonal to the axial direction.

With this structure, the inner ends in the end areas 664A, 664C of the film 664 are supported by the support plates 121 and stress can be produced differently in size between the outer end and the inner end, with respect to the axial direction, in each end area 664A, 664C of the film 664 during rotation of the film 664.

While the invention has been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the invention disclosed herein. It is intended that the specification and the described examples only are illustrative with the true scope of the invention being defined by the following claims.

For instance, in the fourth and fifth embodiments, the thickness regulating sheets 101 are attached to the film 340, 440 to change stress to be produced therein. However, instead of the thickness regulating sheets 101, thickness of the film 340, 440 may be changed in the areas 64A and 64C.

What is claimed is:

1. A toner cartridge comprising:

a toner storing portion configured to store toner therein;

a rotating shaft rotatably disposed in the toner storing portion, the rotating shaft including a fixing portion, which extends away from the rotating shaft in a direction orthogonal to a longitudinal direction of the rotating shaft;

a flexible member having a base end attached to an end of the fixing portion and a free end opposite to the base end, the flexible member extending along a longitudinal direction of the rotating shaft, the flexible member configured to bend at the free end, the flexible member including a slit, the slit extending toward the rotating shaft from the free end of the flexible member, the flexible member configured to have different flexibilities at a first end and a second end of at least one of a plurality of areas of the flexible member partitioned by the slit, the first end and the second end being separated from each other in the longitudinal direction of the rotating shaft; and a supporting member which is a plate-shaped member having at least a first side which extends away from the rotating shaft parallel to the fixing portion and a second side which contacts the flexible member at a first support point and extends away from the fixing portion in a direction parallel to the flexible member.

2. The toner cartridge according to claim 1, further comprising:

another flexible member; and another supporting member, wherein the flexible members extend in opposite directions from each other with respect to the rotating shaft, one supporting member is disposed in the first end of the first flexible member, and another supporting member is disposed in the second end of the second flexible member.

3. The toner cartridge according to claim 1, further comprising:

another supporting member.

4. The toner cartridge according to claim 3, wherein the flexible member includes two or more slits and the supporting members are provided equal in number to said two or more slits.

5. The toner cartridge according to claim 1, further comprising another supporting member configured to support the flexible member at a second support point, the second support point being located in the second end and located between the fixing portion and the free end of the flexible member, wherein the first support point is located in the first end, and a distance from the first support point to the free end of the flexible member is smaller than a distance from the second support point to the free end of the flexible member.

6. The toner cartridge according to claim 1, wherein the first support point is located in the first end of each end area of the plurality of areas of the flexible member, and the first end is an outer end of the flexible member.

7. The toner cartridge according to claim 6, wherein the flexible member includes two or more slits.

8. The toner cartridge according to claim 1, wherein the flexible member is a sheet of film, and the first end is different in thickness from the second end.

9. The toner cartridge according to claim 8, further comprising:

a thickness regulating member affixed to the first end or the second end, the thickness regulating member being made of the same material as the film with the same thickness as the film.

10. The toner cartridge according to claim 1, further comprising:

a developing portion formed adjacent to the toner storing portion and communicating with the toner storing portion via a toner supply opening; and a developing roller disposed in the developing portion and configured to carry toner supplied from the toner storing portion via the toner supply opening to the developing portion.

11. The toner cartridge according to claim 10, wherein the toner storing portion communicates with the developing portion via a toner returning opening.

12. The toner cartridge according to claim 1, wherein the support member is configured to urge the at least one of the first end and the second end of the flexible member upon a rotation of the flexible member about the rotating shaft.

13. The toner cartridge according to claim 1, wherein the first end is an outer end of the flexible member, and the second end is an inner end of the flexible member.

14. An agitating member disposed in a toner storing portion and configured to mix toner stored in the toner storing portion, the agitating member comprising:

a rotating shaft rotatably disposed in the toner storing portion, the rotating shaft including a fixing portion, which extends away from the rotating shaft in a direction orthogonal to a longitudinal direction of the rotating shaft; and a flexible member having a base end attached to an end of the fixing portion and a free end opposite to the base end, the flexible member extending along a longitudinal direction of the rotating shaft, the flexible member configured to bend at the free end, the flexible member including a slit, the slit extending toward the rotating shaft from the free end of the flexible member, the flexible member configured to have different flexibilities at a first end and a second end of at least one of a plurality of areas of the flexible member partitioned by the slit the first end and the second end being separated from each other in the longitudinal direction of the rotating shaft; and a supporting member which is a plate-shaped member having at least a first side which extends away from the rotating shaft parallel to the fixing portion and a second side which contacts the flexible member at a first support point and extends away from the fixing portion in a direction parallel to the flexible member.

15. An image forming apparatus configured to form an image on a recording medium, comprising:

a photosensitive member to which an electrostatic latent image corresponding to an image to be formed on the recording medium is formed;

a toner storing portion configured to store toner therein;

a rotating shaft rotatably disposed in the toner storing portion, the rotating shaft including a fixing portion, which extends away from the rotating shaft in a direction orthogonal to a longitudinal direction of the rotating shaft;

a flexible member having a base end attached to and end of the fixing portion and a free end opposite to the base end, the flexible member extending along a longitudinal direction of the rotating shaft, the flexible member configured to bend at the free end, the flexible member including a slit, the slit extending toward the rotating shaft from the free end of the flexible member, the flexible member configured to have different flexibilities at a first end and a second end of at least one of a plurality of areas of the flexible member partitioned by the slit, the first end and the second end being separated from each other in the longitudinal direction of the rotating shaft;

a supporting member which is a plate-shaped member having at least a first side which extends away from the rotating shaft parallel to the fixing portion and a second side which contacts the flexible member at a first support point and extends away from the fixing portion in a direction parallel to the flexible member.

a developing portion formed adjacent to the toner storing portion, the developing portion communicating with the toner storing portion via a toner supply opening; and a developing roller disposed in the developing portion, the developing roller configured to carry toner supplied from the toner storing portion via the toner supply opening to the developing portion, supply the toner to the photosensitive member, and develop the electrostatic latent image with toner.

16. A toner cartridge comprising:

a toner storing portion including a toner supply opening through which toner is dispensed, the toner storing portion including an interior surface;

a rotating shaft rotatably disposed in the toner storing portion, the rotating shaft having an axial direction;

a generally rectangular, flexible film having a base end attached to the rotating shaft and a free end opposite to the base end, the free end configured to slidably contact the interior surface of the toner storing portion, the base end attached to the rotating shaft, the flexible film including slits, each slit extending from the free end toward the base end, wherein the flexible film includes a plurality of first areas and a second area along the axial direction of the rotating shaft and separated by the slits, the plurality of first areas and second area not having any holes therein, and each first area being wider in the axial direction than the second area in the axial direction, and wherein the toner supply opening is located closer to an axial end of the rotating shaft than to a center of the rotating shaft and a portion of the second area intersects a plane orthogonal to the axial direction passing through the toner supply opening.

17. The toner cartridge according to claim 16, wherein the plurality of first areas is configured to provide some toner movement in the axial direction during rotation of the rotating shaft, and wherein a net flow direction of the toner through a full rotation of the rotating shaft is toward the toner supply opening.

18. The toner cartridge according to claim 16, wherein the slits extend orthogonally to a line parallel to the axial direction from the free end toward the base end.

19. The toner cartridge according to claim 16, wherein the plurality of first areas is two first areas, and wherein the widths of the first areas are the same.

20. A toner cartridge comprising: a toner storing portion including a toner supply opening through which toner is dispensed, the toner storing portion including an interior surface;

a rotating shaft rotatably disposed in the toner storing portion, the rotating shaft having an axial direction, the toner supply opening being located closer to an axial end of the rotating shaft than to a center of the rotating shaft, a flexible film having a base end attached to the rotating shaft and a free end opposite to the base end, the free end configured to slidably contact the interior surface of the toner storing portion, the flexible film including slits, each slit extending from the free end toward the base end, the flexible film including at least a first area and a second area along the axial direction of the rotating shaft and defined between the slits, the first and second areas not having any holes therein, a part of the second area facing the toner supply opening, the first area being located closer to a center of the rotating shaft than the second area, wherein the first area includes a first side edge at the free end and a second side edge at the free end, the second side edge on a side of the first area opposite a side including the first side edge, the second side edge being located closer to a center of the rotating shaft than the first side edge, the second side edge leading the first side edge in contacting the interior surface of the toner storing portion, and wherein the second area includes a third side edge and a fourth side edge at the free end, the fourth side edge on a side of the second area opposite a side including the third side edge, the fourth edge being located closer to a center of the rotating shaft than the third side edge.

21. The toner cartridge according to claim 20, wherein a distance between the first side edge and the second side edge is greater than a distance between the third side edge and the fourth side edge.

22. The toner cartridge according to claim 20, wherein a first amount of deflection between the free end at the first side edge and the free end at the second side edge is greater than a second amount of deflection between the free end at the third side edge and the free end at the fourth side edge.

23. The toner cartridge according to claim 20, wherein a first distance between the free end at the first side edge and the free end at the second side edge is greater than a second distance between the free end at the third side edge and the free end at the fourth side edge as measured on an imaginary plane orthogonal to the axial direction.

24. The toner cartridge according to claim 20, wherein the base end is offset from an axis of rotation of the rotating shaft.

25. The toner cartridge according to claim 20, wherein the slits extend orthogonally to a line parallel to the axial direction from the free end toward the base end.

26. The toner cartridge according to claim 20, wherein the first area is wider than the second area.

27. The toner cartridge according to claim 20, wherein the flexible film includes two or more first areas.

* * * * *